US008651032B2

(12) United States Patent
Otani et al.

(10) Patent No.: US 8,651,032 B2
(45) Date of Patent: Feb. 18, 2014

(54) CLASSIFICATION DEVICE, VERTICAL PULVERIZING APPARATUS USING THE SAME, AND COAL FIRED BOILER APPARATUS

(75) Inventors: Yoshinori Otani, Kure (JP); Hiroaki Kanemoto, Kure (JP); Shinichiro Nomura, Kure (JP); Hideo Mitsui, Kure (JP); Yutaka Takeno, Kure (JP)

(73) Assignee: Babcock-Hitachi Kabushiki Kaisha, Tokyo (JP)

( * ) Notice: Subject to any disclaimer, the term of this patent is extended or adjusted under 35 U.S.C. 154(b) by 401 days.

(21) Appl. No.: 12/679,858

(22) PCT Filed: Sep. 26, 2008

(86) PCT No.: PCT/JP2008/067509

§ 371 (c)(1),
(2), (4) Date: Mar. 24, 2010

(87) PCT Pub. No.: WO2009/041628

PCT Pub. Date: Apr. 2, 2009

(65) Prior Publication Data

US 2010/0236458 A1 Sep. 23, 2010

(30) Foreign Application Priority Data

Sep. 27, 2007 (JP) ..... 2007-252135

(51) Int. Cl.
*F23K 1/00* (2006.01)

(52) U.S. Cl.
USPC ..... 110/232; 241/24.24; 209/139.2; 209/143

(58) Field of Classification Search
USPC ..... 110/232; 209/713, 143, 135, 148, 710, 209/714; 241/24.24, 80, 119, 79.3
See application file for complete search history.

(56) References Cited

U.S. PATENT DOCUMENTS

| | | | | |
|---|---|---|---|---|
| 4,684,069 | A | 8/1987 | Hashimoto et al. | |
| 5,120,431 | A * | 6/1992 | Cordonnier | 209/135 |
| 5,511,668 | A | 4/1996 | Keuschnigg | |
| 5,533,629 | A * | 7/1996 | Ito et al. | 209/714 |
| 5,957,300 | A * | 9/1999 | Nardi et al. | 209/143 |
| 6,827,221 | B1 * | 12/2004 | Brundiek et al. | 209/210 |

(Continued)

FOREIGN PATENT DOCUMENTS

| | | | |
|---|---|---|---|
| JP | 61-50678 | A | 3/1986 |
| JP | 63-141640 | U | 9/1988 |

(Continued)

OTHER PUBLICATIONS

International Search Report dated Dec. 16, 2008 (Four (4) pages).

*Primary Examiner* — Kenneth Rinehart
*Assistant Examiner* — Jason Lau
(74) *Attorney, Agent, or Firm* — Crowell & Moring LLP

(57) ABSTRACT

To provide a classification device in which product fine powder little in mixture ratio of coarse particles can be obtained. A classification device characterized in that a setting pitch P between stationary fins 13 and a width L of each stationary fin 13 are combined so that a value of P/L is in a range between $0.042\times(\theta-50)+0.64$ and $0.019\times(\theta-50)+0.22$ in $50°\leq\theta\leq70°$ when θ is an inclination angle of each stationary fin 13, P is the setting pitch, and L is the width in a direction of circulation of particles.

8 Claims, 19 Drawing Sheets

(56) References Cited

U.S. PATENT DOCUMENTS

| | | | | |
|---|---|---|---|---|
| 6,902,126 | B2 * | 6/2005 | Chen et al. | 241/79.1 |
| 7,156,235 | B2 * | 1/2007 | Eisinger | 209/138 |
| 7,690,591 | B2 * | 4/2010 | Baetz et al. | 241/79.1 |
| 7,712,611 | B2 * | 5/2010 | Longhurst et al. | 209/143 |
| 2003/0075486 | A1 * | 4/2003 | Sussegger et al. | 209/135 |
| 2007/0228194 | A1 | 10/2007 | Takeno et al. | |
| 2012/0012687 | A1 * | 1/2012 | Vierstra | 241/79 |

FOREIGN PATENT DOCUMENTS

| | | | |
|---|---|---|---|
| JP | 5-51484 | U | 7/1993 |
| JP | 6-134401 | A | 5/1994 |
| JP | 7-195037 | A | 8/1995 |
| JP | 2002-119920 | A | 4/2002 |
| JP | 2002-233825 | A | 8/2002 |
| JP | 2005-324104 | A | 11/2005 |

* cited by examiner

CLASSIFICATION DEVICE, VERTICAL PULVERIZING APPARATUS USING THE SAME, AND COAL FIRED BOILER APPARATUS

TECHNICAL FIELD

The present invention relates to a classification device which separates particles in a solid-gas two-phase flow into coarse particles and fine particles, and particularly relates to a classification device which is preferably incorporated in a vertical pulverizing apparatus such as a coal fired boiler apparatus.

BACKGROUND ART

In a thermal power generation coal fired boiler apparatus for firing pulverized coal as fuel, a vertical roller mill is used in a fuel supply device. A conventional example thereof is shown in FIG. 27.

This vertical roller mill has a grinding zone 5 which pulverizes coal as a raw material of finely pulverized coal by inducing between a grinding table 2 and heavily loaded grinding rollers 3, and a classification zone 6 which is provided on top of the grinding zone 5 so as to classify pulverized coal into an arbitrary particle size.

Describing the operation of the vertical roller mill, a subject 50 of pulverization as coal fed from a coal supply pipe (raw material supply pipe) 1 falls down to a center zone of the rotating grinding table 2 and then moves to an outer circumferential zone thereof while tracing a vertical locus on the grinding table 2 based on centrifugal force caused by the rotation of the grinding table 2 as represented by arrows, so that the subject 50 is induced between the grinding table 2 and the grinding roller 3 and pulverized.

The pulverized subject is blown up while dried by hot air 51 introduced from a throat 4 provided in the circumference of the grinding table 2. Part of the blown-up powder large in particle size falls down 55 by gravitation during conveyance toward the classification zone 6 so as to return to the grinding zone 5 (primary classification).

The group of particles which have reached the classification zone 6 are classified into fine particles 54 smaller than a predetermined particle size and coarse particles 53 not smaller than the predetermined particle size by the classification zone 6 (secondary classification). The coarse particles 53 fall down to the grinding zone 5 located in a lower zone of the vertical pulverizing apparatus, so that the coarse particles 53 are pulverized again. On the other hand, the fine particles 54 which have come out of the classification zone 6 are fed to a boiler (not shown) through a coal feed pipe (product fine powder discharge pipe) 30.

As shown in FIGS. 28 and 29, a two-stage type classification device composed of a combination of a stationary classifier 10 disposed in an inlet of the classification device and a rotary classifier 20 disposed in the inside of the stationary classifier 10 is generally used as the conventional classification device forming the aforementioned classification zone 5.

The stationary classifier 10 is hung down from a classification zone top plate 40, and has a large number of stationary fins 12 which are arranged in a circumferential direction and which are disposed at an arbitrary angle with respect to the center axis direction of the classification device, and a rectifying cone 11 which is shaped like a downward convexly conical shape and which is provided under the stationary fins 12. The rotary classifier 20 has a large number of rotary fins 21 which are provided in a circumferential direction and which are disposed at an arbitrary angle with respect to the center axis direction of the classification device so that a length direction of a plate faces a vertical direction.

The operation of the two-stage type classification device will be described with reference to FIGS. 28 and 29. A solid-gas two-phase flow 52 blown up for below and introduced into the classification device is rectified and at the same time subjected to weak swirling in advance when the solid-gas two-phase flow 52 passes through the stationary fins 12.

When the solid-gas two-phase flow 52 has reached the rotary fins 21 rotating at a predetermined rotational speed on the center axis of the device as an axial center, strong swirling is given to the solid-gas two-phase flow 52 so that force to bounce out particles in the solid-gas two-phase flow 52 to the outside of the rotary fins 21 by centrifugal force is applied on the particles in the solid-gas two-phase flow 52. On this occasion, centrifugal force applied on coarse particles 53 with large mass is large, so that the coarse particles 53 are separated by an air flow passing through the rotary fins 21. The coarse particles 53 settle down sedimentarily in a space between the rotary fins 21 and the stationary fins 12 by gravitation, so that the coarse particles 53 finally fall down to the grinding zone 5 provided as a lower zone, along an inner wall of the rectifying cone 11.

On the other hand, fine particles 54 are carried with the air flow because centrifugal force applied on the fine particles 54 is small, so that the fine particles 54 pass through the rotary fins 21 so as to be discharged to the outside of the vertical pulverizing apparatus as shown in FIG. 27. Incidentally, the particle size distribution in product fine powder can be controlled when the number of revolutions of the rotary classifier 20 is adjusted. Incidentally, a reference numeral 22 in the drawing designates a direction of rotation of each rotary fin 21, and a reference numeral 41 designates a classification portion outer circumference housing.

FIG. 32 is a schematic configuration diagram showing the whole of a coal fired boiler apparatus having this vertical roller mill. Combustion air A fed in by a forced draft fan 57 branches out into primary air A1 and secondary air A2. The primary air A1 branches out into air directly fed as cold air to the vertical roller mill 59 by a primary air forced draft fan 58 and air fed to the vertical roller mill 59 after heated by an exhaust gas type air preheater 64. Then, the cold air and warm air are mixed and adjusted to optimize the temperature of mixture air, so that the mixture air is fed as the hot air 51 to the vertical roller mill 59.

After raw coal which is a subject 50 of pulverization is put into a coal banker 65, a predetermined quantity of the raw coal is fed to the vertical roller mill 59 by a coal feeder 66 and pulverized. The generated finely-pulverized coal pulverized while dried with the primary air A1 is conveyed with the primary air A1 and fed to a boiler 67 through a pulverized coal burner in a wind box 68, so that the pulverized coal is ignited and burned. The secondary air A2 is heated by a steam type air preheater 69 and the exhaust gas type air preheater 64 and then fed to the wind box 68, so that the secondary air A2 is provided for burning of pulverized coal in the boiler 67.

There is provided a system in which an exhaust gas produced by firing of pulverized coal is discharged from a stack 74 to the atmospheric air after dust is removed by a dust collector 70, nitrogen oxide (NOx) is reduced by a denitrater 71, the exhaust gas is sucked in by a induced draft fan 72 via the exhaust gas type air preheater 64 and a sulfur component is removed by a desulfurizer 73.

For example, the following Patent Document concerned with the classification device can be listed below.

Patent Document 1: JP-A-2002-233825

DISCLOSURE OF THE INVENTION

Problems that the Invention is to Solve

Pulverized coal fed to a coal fired boiler apparatus needs to be pulverized more finely than a predetermined particle size distribution in order to reduce an air pollutant such as NOx and an unburned carbon in ash. Particularly, the unburned carbon in ash has large influence on boiler efficiency, and reduction of the unburned carbon permits coal ash to be recycled as fly ash. In the conventional two-stage type classification device, the mixture ratio of 100 mesh-over can be reduced to 2% by weight or less in an ordinary operating condition that the mass ratio of 200 mesh-under (75 μm or less) fine particles as product fine powder is 80%-90%.

Various types of coal have been used in coal fired boiler apparatuses in recent years. Among these, there are coal which is so poor in pulverizing characteristic that a great deal of power consumption is required for making the particle size distribution fine, and coal which causes self-excited vibration in the pulverization portion when the 200 mesh-under ratio of product fine powder is increased. In coal having such characteristic, 200 mesh-under cannot be increased to 80%-90% so that 100 mesh-over increases to several % or more. As a result, we are confronted with a problem that air pollutants such as NOx and unburned carbon in ash cannot be reduced.

There is a problem that classifying performance of the rotary classifier is worsened because of characteristic of the vertical roller mill, that is, because flow velocity deviation occurs in the stationary classifier inlet and the flow velocity deviation is not eliminated even in the rotary classifier inlet disposed on the downstream side of the stationary classifier. As for performance of the classification device, when a uniform flow velocity distribution is given by the inner classification device (rotary classifier) which makes the great part of a separating operation, sharp classification can be made.

There is another characteristic than the above description, that is, dispersion of particles is insufficient to obtain poor classifying accuracy when the powder concentration is high. It is assumed that this is caused by interference or partial aggregation of particles high in coal concentration. Generally, when coal is pulverized by the vertical roller mill, the powder concentration discharged from the mill is in a range of 0.3 $kg/m^3$ to 0.6 $kg/m^3$. However, because the circulation quantity increases due to collection coarse powder by the stationary classifier 10 and so on, the powder concentration in the inlet of the rotary classifier 20 is substantially not smaller than about 2 $kg/m^3$.

Accordingly, it is necessary to keep the flow velocity or powder concentration as constant as possible in the inlet of the rotary classifier 20 to prevent a high concentration region from being generated. As a countermeasure, a method in which fins used in the stationary classifier 10 are of a horizontal louver type (slat type) so that the flow velocity distribution in the inlet of the rotary classifier 20 is kept constant is effective. In addition, a method in which the shape of each conventional stationary fin is kept but a part thereof is used as support members of horizontal louvers is effective.

When performance of the classification device is worsened, fine powder to be discharged as a product from the mill outlet is not discharged but fed to the mill grinding zone and then goes through the pulverizing process again. For this reason, fine powder is caught into the mill roller, so that self-excited vibration accordingly occurs in the roller and the quantity of coal held in the mill grinding zone increases. Consequently, lowering of the quantity of pulverization and increase of grinding power consumption are brought.

The invention is accomplished in consideration of such circumstances in the background art. A first object of the invention is to provide a classification device which can obtain product fine powder little in mixture ratio of coarse particles.

A second object of the invention is to provide a vertical pulverizing apparatus which can attain reduction in differential pressure of a pulverized particle layer in the inside of the apparatus, reduction in grinding power consumption and prevention of self-excited vibration.

A third object of the invention is to provide a coal fired boiler apparatus in which an unburned carbon in ash can be kept low to attain improvement of boiler efficiency even when poor pulverizable coal or coal easily causing induction of self-excited vibration in a vertical pulverizing apparatus is used.

Means for Solving the Problems

A first means of the invention for achieving the first object is a classification device including:

a stationary classifier substantially shaped like a cylinder and hung down from a device top portion;

a rotary classifier disposed inside the stationary classifier;

a cylindrical deflection ring hung down from the device top portion between the stationary classifier and the rotary classifier to form a downward flow;

a rectifying cone shaped like a downward convexly curved cone and disposed under the stationary fins; and a classification zone outer circumference housing which covers a classification portion composed of the stationary classifier, the rotary classifier, the deflection ring, the rectifying cone, etc.;

the rotary classifier including a large number of rotary fins arranged in a circumferential direction, each rotary fin having a length direction of a plate facing a vertical direction and disposed at an arbitrary angle with respect to a direction of a center axis of the device, characterized in that:

the stationary classifier includes stationary fin groups attached multistageously and each having a plurality of stationary fins disposed annularly with respect to the center axis of the device, each of the stationary fins being inclined down toward the direction of the center axis of the device; and when an ascending solid-gas two-phase flow composed of a mixture of solid particles and a gas enters between the classification zone outer circumference housing and the stationary fin groups and passes between the stationary fins inclined down, the solid-gas two-phase flow collides with surfaces of the stationary fins and changes into a downward flow so that coarse particles with large mass on this occasion fall down toward the rectifying cone side located in a lower portion while solid particles not falling down are carried with an air flow and flow toward the deflection ring and rotary fin side.

A second means of the invention is a classification device according to the first means, characterized in that: both end portions of each stationary fin are supported by support members and the stationary fins are annularly connected to one another through the support members.

A third means of the invention is a classification device according to the second means, characterized in that: a value of $H/H_{RF}$ is limited to ⅓ or less when H is a length of the deflection ring from the device top portion, and $H_{RF}$ is a length of each rotary fin.

A fourth means of the invention is a classification device according to the first means, characterized in that: an inclination angle of each stationary fin is limited to a range of 50° to 70° with respect to a horizontal direction.

A fifth means of the invention is a classification device described in Claim 4, wherein the classification device is characterized in that a setting pitch P between the stationary fins and a width L of each stationary fin in a direction of particles flowing are combined so that a value of P/L is in a range defined by an upper limit line $P/L=0.042\times(\theta-50)+0.65$ in a range $50°\leq\theta\leq70°$, a lower limit line $P/L=0.4$ in a range $50°\leq\theta\leq60°$, and a lower limit line $P/L=0.019\times(\theta-60)+0.4$ in a range $60°\leq\theta\leq70°$, when θ is an inclination angle of each stationary fin, P is the setting pitch between the stationary fins, and L is the width of each stationary fin in the direction of particles flowing.

A sixth means of the invention is a classification device according to any one of the first to fifth means, characterized in that: support members supporting the stationary fins are constituted by a plurality of plate-like members so that a setting angle of each support member is set in such manner that a direction of a gas and particle flow in a section of the classification device after passage through the support members is adjusted to a direction of rotation of the rotary classifier provided inward of the stationary fins.

A seventh means of the invention is a classification device according to the sixth means, characterized in that: a width of each of the support members is extended and stretched inward so as to be larger than a width of each stationary fin.

An eighth means of the invention is a classification device according to any one of the first to fifth means, characterized in that: rectifying plates formed of a plurality of flat plates are provided in a vertical direction so as to be near to an outer circumference or inner circumference of the stationary fins so that a setting angle of the rectifying plates is set in such a manner that a direction of a gas and particle flow in a section of the classification device after passage through the rectifying plates is adjusted to a direction of rotation of the rotary classifier provided inward of the stationary fins.

A ninth means of the invention for achieving the second object is a vertical pulverizing apparatus including a grinding zone having a grinding table and a grinding parts such as a grinding roller and a classification zone disposed on top of the grinding zone, so that a pulverized substance pulverized by the grinding zone is conveyed with an upward air flow from a throat provided on an outer circumference of the grinding table, and the conveyed pulverized substance is classified by the classification zone in such a manner that fine particles classified thus are taken out of the device while coarse particles classified thus are pulverized again by the grinding zone, characterized in that: the classification zone is formed of a classification device according to any one of the first to eighth means.

A tenth means of the invention for achieving the third object is a coal fired boiler apparatus including a vertical pulverizing apparatus for pulverizing coal, and a boiler for burning pulverized coal obtained by pulverization in the vertical pulverizing apparatus, characterized in that: the vertical pulverizing apparatus is a vertical pulverizing apparatus according to the ninth means.

Effect of the Invention

The invention is configured as described above. By the first to eighth means, it is possible to provide a classification device which can obtain product fine powder little in mixture ratio of coarse particles.

Moreover, by the ninth means, it is possible to provide a vertical pulverizing apparatus which can attain reduction in differential pressure of a pulverized particle layer in the inside of the apparatus, reduction in grinding power consumption and prevention of self-excited vibration.

In addition, by the tenth means, it is possible to provide a coal fired boiler apparatus in which an unburned carbon in ash can be kept low to attain improvement of boiler efficiency even when poor pulverizable coal or coal easily causing induction of self-excited vibration in a vertical pulverizing apparatus is used.

BEST MODE FOR CARRYING OUT THE INVENTION

Embodiments of the invention will be described below with reference to the drawings. FIGS. 1 to 3 are views for explaining a classification device according to a first embodiment of the invention. FIG. 1 is a schematic vertical sectional view showing important part of the classification device, FIG. 2 is a schematic horizontal sectional view taken along the line A-A in FIG. 1, and FIG. 3 is a schematic horizontal sectional view taken along the line A-A in FIG. 1, showing a modification of stationary fins. Incidentally, the schematic configuration of a vertical roller mill having this classification device is the same as that shown in FIG. 27 and description thereof will be omitted.

As shown in FIG. 1, the classification device is provided as a two-stage type classification device having a combination of a stationary classifier 10 substantially shaped like a cylinder and disposed on an inlet side of the classification device and a rotary classifier 20 disposed inside the stationary classifier 10.

The stationary classifier 10 has support members 14 each shaped like a long plate, stationary fins 13 each having opposite end portions supported by the support members 14 as shown in FIG. 2, and a rectifying cone 11 shaped like a downward convexly conical shape and disposed under the support members 14.

As shown in FIG. 1, the stationary fins 13 are multistageously attached at regular intervals at a constant angle θ downward with respect to the direction of the center axis of the classification device. As shown in FIG. 2, the respective stationary fins 13 (louvers) are annularly connected to one another through the support members 14.

As shown in FIG. 2, each stationary fin 13 made of a flat plate having inner and outer circumferential edges shaped like circular arcs has opposite ends fixed by the support members 14. As for a method of fixing the stationary fins 13, the stationary fins 13 are inserted in the support members 14 and fixed by means of welding, screwing or the like. The planar shape of each stationary fin 13 is not limited to a circular arc and stationary fins 13 shaped like rectangles in planar view as shown in FIG. 3 may be used. In this case, the stationary fins 13 are arranged annularly with respect to the center axis of the classification device so that each fin 13 is inclined down toward the center of the classification device.

A deflection ring 33 shaped like a cylinder is disposed between the stationary fins 13 and the rotary fins 21 so as to be hung down from a classification zone top plate 40.

The operation of the classification device will be described next with reference to FIG. 1. When particles in a solid-gas two-phase flow 52 ascending from a grinding zone 5 (see FIG. 27) go between the stationary fins 13 and a classification zone outer circumference housing 41 and pass between the stationary fins 13, the particles collide with surfaces of the stationary fins (louvers) 13 and then change into a downward flow. On this occasion, coarse particles with large mass are separated from an air flow passing through the rotary fins 21 due to downward inertia force and gravitation, so that the coarse particles fall down toward the rectifying cone 11 located in a lower zone. On the other hand, fine particles carried with the air flow flow toward the rotary fins 21 due to small downward inertia force and gravitation.

A result of examination in the case where the inclination angle, width and pitch of the stationary fins (louvers) 13 and the length of the deflection ring 33 are optimized by flow analysis and cold model test will be shown below. FIG. 4 is a reference view in which symbols are attached to respective portions of the classification device. The respective symbols in the drawing are as follows.

L: width of each stationary fin (louver) 13 in a direction of particles flowing (louver width)

θ: inclination angle between each louver 13 with respect to the horizontal direction (louver angle)

P: setting pitch between the stationary fins 13 (louver pitch)

H: vertical length of the deflection ring 33 (deflection ring length)

$H_{RF}$: vertical length of each rotary fin 21 (rotary fin length)

Rr: inner radius of each louver 13 (louver inner diameter)

Rh: distance from the center of the classification device to the deflection ring 33 (deflection ring position)

FIG. 5 is a view showing configurations of classification devices of three types A, B and C and results of flow analysis of the respective classification devices. In the drawing, the type A is a classification device which has the conventional structure described with reference to FIG. 28 and in which vertically long flat plate-shaped stationary fins 12 and rotary fins 21 are provided. The type B is a classification device in which a deflection ring 33 is provided between the vertically long flat plate-shaped stationary fins 12 and the rotary fins 21 and which has a configuration described in Patent Document 1. The type C is a classification device according to the embodiment of the invention shown in FIG. 1.

Inlet flow velocity distributions of the rotary fins 21 in these three types of classification devices are shown in FIG. 5D. The horizontal axis shows a flow velocity of particles into each rotary fin, and the vertical axis shows the vertical position of the rotary fin. Incidentally, for example, rotary fin vertical position −0.06 m in the vertical axis indicates a position 0.06 m downward distant from the upper end of each rotary fin 21.

As is apparent from the results of FIG. 5D, the type A is large in deviation of the flow velocity distribution because the flow velocity to each rotary fin has a peak in a position near the upper end of the rotary fin 21. In the type B, the peak position descends to a nearly center position of each rotary fin but the flow velocity distribution is still biased. In comparison with these, the type C exhibits little peak of the flow velocity to each rotary fin so that it is found out that the flow velocity in the rotary fin inlet is substantially uniform. Incidentally, the classification device of the type C used in this analysis has the louver angle θ set at 60°.

FIG. 30 is a graph showing the flow velocity distribution in the rotary fin inlet in the classification device of the type A. As shown in the graph, the flow velocity distribution is uneven in the direction of the height of the rotary fin and there is a tendency that the flow velocity in the upper portion of the classification device is high but the flow velocity in the lower portion of the classification device is low. This is because a gap of the stationary classifier is opened vertically.

Because the separation ratio of particles in the rotary classifier is larger than that in the stationary classifier, the flow velocity distribution in the rotary classifier inlet is important. The separation diameter due to the rotary classifier is uniquely determined by the ratio of fluid drag force due to the flow velocity of air flowing into the rotary classifier to centrifugal force generated in the rotary classifier. Accordingly, unevenness of the air flow in the rotary classifier inlet leads to lowering of particle separation performance. On the contrary, evenness of the flow velocity distribution in the rotary classifier inlet leads to improvement in classifying performance.

Because the theoretical classification particle diameter Dth in rotary classification is determined based on the ratio of the rotational velocity Vr (centrifugal force) of each rotary fin to the flow velocity Va of air flowing into the rotary fin as represented by equation (1), variation of the flow velocity distribution in the rotary classifier inlet directly leads to variation of Dth.

$$Dth = C/Vr(18\,\mu rVa/(\rho s-\rho))^{0.5} \quad (1)$$

in which r is the outer radius of each rotary fin, μ is air viscosity, ρs is particle density, ρ is air density, C is a correction coefficient.

FIG. 31 is a graph showing the behavior of particles conveyed from the grinding zone to the stationary classifier and the rotary classifier in the inside. Coal particles blown up with gas or air from the grinding zone collide with the mill upper zone (stationary classifier upper portion) and are led to the rotary classifier via the stationary classifier. It is a matter of course that a high coal concentration layer is formed in the stationary classifier upper zone, so that concentration deviation is generated because this is not smoothened even in the inlet of the rotary classifier. As described above, powder concentration deviation generated in the mill upper zone cannot be eliminated easily in the conventional stationary classifier.

A result of examination about optimization of the louver structure in the classification device according to the invention will be described next. FIG. 6 is a graph showing the relation between the louver angle θ and the ratio (Vmax/Vave) indicating uniformity of the rotary fin inlet flow velocity distribution, where Vmax is the maximum flow velocity of the rotary fin inlet flow velocity and Vave is the average flow velocity thereof. In this graph, it is shown that the particle flow velocity to each rotary fin is equalized as Vmax/Vave approaches 1.

As is apparent from this graph, Vmax/Vave becomes more than 3 when the louver angle is 40° or 80°. It has been confirmed experimentally that when the louver angle is small, the effect of rectifying the flow velocity deviation generated in the inlet of the stationary classifier is small, and on the other hand, when the louver angle is large, the flow velocity deviation becomes large because of concentration of an air flow in the lower portion of the rotary classifier. On the contrary, when the louver angle is set in a range of 50° to 70°, Vmax/Vave can be adjusted to be not larger than 2.5 to attain uniformity of the flow velocity distribution in the rotary fin inlet, and particularly when the louver angle is 60°, Vmax/Vave is minimized.

FIG. 7 is a graph showing the relation between the louver angle and the pressure loss ratio in the stationary classifier. In the graph, the pressure loss ratio is expressed in the ratio (ΔP1/ΔP) of pressure loss ΔP1 at each louver angle to pressure loss ΔP of the stationary classifier at a louver angle of 40°.

As is apparent from this graph, the pressure loss tends to increase as the louver angle increases, but it is found out that the pressure loss ratio is as small as 1.1 even when the louver angle is 70°. Even when the louver angle is constant, the pressure loss due to the louver tends to increase as the louver pitch P is reduced. This tendency becomes strong as the louver angle becomes large.

FIG. 8 is a graph to optimize the louver width L and the louver pitch P at a louver angle of 60° in relation of the flow velocity distribution (Vmax/Vave) in the rotary classifier inlet, obtained by flow analysis. In this graph, the ratio (P/L) of the louver pitch P to the louver width L is taken in the horizontal axis, and (Vmax/Vave) is taken in the vertical axis.

As is apparent from this graph, when P/L is 1.2, Vmax/Vave tends to increase rapidly. This is because as P/L increases, the gap between louvers becomes large and the effect of rectifying an air flow is therefore reduced.

On the other hand, when the value of P/L is in a range of 0.1 to 1.1, Vmax/Vave can be set to be not larger than 2.5 so that uniformity of the flow velocity distribution in the rotary fin inlets can be attained. However, because pressure loss of the stationary classifier due to the louvers tends to increase when the value of P/L becomes as low as 0.1, it is preferable that the value of P/L is not smaller than 0.4. Accordingly, the upper limit value of P/L is 1.1, preferably not larger than 0.8. On the other hand, the lower limit of P/L is 0.4, preferably not smaller than 0.5. Accordingly, the limited range of P/L is 0.4 to 1.1, preferably 0.5 to 0.8.

FIG. 9 is a graph of the obtained relation between P/L at a louver angle of 70° and Vmax/Vave. It is found out that in the case where the louver angle is as large as 70°, Vmax/Vave becomes smallest when P/L is 1.1. This means that equalization of the flow velocity in the outlet of the classification device can be attained when the louver pitch is increased or the louver width is reduced (i.e. P/L is increased) compared with the case where the louver angle is 60°. In the case where the louver angle is 70°, it is preferable that P/L is limited to a range of 0.6-1.5, more preferably to a range of 1.0-1.1.

FIG. 10 is a graph of the obtained relation between P/L and Vmax/Vave at a louver angle of 50°. In the case where the louver angle is 50°, Vmax/Vave can be set to be not larger than 2.5 when the value of P/L is in a range of 0.4 to 0.75, so that uniformity of the flow velocity distribution in the rotary fin inlets can be attained. However, when the louver angle is 50° to make louver inclination relatively gentle and the value of P/L is 0.75, the gap between the louvers becomes so large that the air flow rectifying effect tends to decrease, and there is fear that Vmax/Vave will become larger than 2.5 according to circumstances. Accordingly, it is preferable that the upper limit value of P/L at a louver angle of 50° is restricted to 0.65. Accordingly, in the case where the louver angle is 50°, it is preferable that P/L is limited to a range of 0.4 to 0.65.

From the aforementioned analytic result, Vmax/Vave can be kept small by limiting P/L to a range of 0.4 to 0.65 when the louver angle is 50°, by limiting P/L to a range of 0.4 to 1.1 when the louver angle is 60°, or by limiting P/L to a range of 0.6 to 1.5 when the louver angle is 70°.

FIG. 11 is a graph collectively showing the optimum range of P/L in the louver angle range of 50° to 70° based on these results.

In the graph, the upper limit line can be expressed as $P/L=0.042\times(\theta-50)+0.65$ in a louver angle θ range of 50° to 70°, and the lower limit line can be expressed as $P/L=0.4$ in a louver angle θ range of 50° to 60° and as $P/L=0.019\times(\theta-60)+0.4$ in a louver angle θ range of 60° to 70°. Incidentally, 0.042 and 0.019 in the equations are coefficients with a unit of 1/deg.

Accordingly, by combining the louver width L and the louver fin pitch P so that the value of P/L is in a range defined by the upper limit line $P/L=0.042\times(\theta-50)+0.65$ in a range $50°\leq\theta\leq70°$, the lower limit line $P/L=0.4$ in a range $50°\leq\theta\leq60°$, and the lower limit line $P/L=0.019\times(\theta-60)+0.4$ in a range $60°\leq\theta\leq70°$, the flow velocity distribution in the rotary classifier inlet can be equalized.

A result of examination about optimization of the deflection ring length will be described next. FIG. 12 is a graph showing the relation between the ratio ($H/H_{RF}$) of the deflection ring length H to the rotary fin length $H_{RF}$ and Vmax/Vave when the louver angle θ is fixed to 60°.

As is apparent from this graph, it is found out that Vmax/Vave becomes slightly small when the deflection ring length ratio ($H/H_{RF}$) is in a range of 0 to 0.3, but Vmax/Vave becomes large when the deflection ring length ratio ($H/H_{RF}$) is larger than 0.35. It can be conceived that this is because as the length of the defection ring increases, the air flow path to the rotary classifier is narrowed and at the same time the downward flow increases so that the flow velocity distribution in the inlet of the rotary classifier is not equalized.

FIG. 13 is a graph showing an experimental result of the pressure loss in the classification device relative to the deflection ring length ratio ($H/H_{RF}$). Here, ΔP2 expresses the pressure loss of the classification device when there is no deflection ring, and ΔP3 expresses the pressure loss of the classification device.

As is apparent from this graph, the pressure loss ratio (ΔP3/ΔP2) of the classification device is the smallest when the deflection ring length ratio ($H/_{RF}$) is zero, the pressure loss ratio (ΔP3/ΔP2) of the classification device increases as the deflection ring length ratio ($H/H_{RF}$) increases, and the pressure loss ratio (ΔP3/ΔP2) of the classification device increases rapidly when the deflection ring length ratio ($H/H_{RF}$) is larger than 0.35. In the respect to reduce the pressure loss, it is necessary to restrict the deflection ring length ratio ($H/H_{RF}$) to a range of 0 to 1/3.

Although the case where the louver angle is set at 60° has been described in FIGS. 12 and 13, the same trend is shown in the case where the louver angle is 50° and in the case where the louver angle is 70°.

FIG. 14 is a classifying characteristic graph showing a mixture ratio of 100 mesh-over (roughly pulverized particle diameter of 150 μm or larger) as an example of classifying characteristic when the 200 mesh-under ratio of fine powder collected from the mill outlet is changed.

As is apparent from this graph, both in the background art and in the present invention (louver angle60°), the 100 mesh-over tends to decrease as the 200 mesh-under ratio increases. The 200 mesh-under ratio operated in the mill is generally in a range of 80% to 90% in terms of weight ratio. When the 200 mesh-under ratio is 80%, the 100 mesh-over is about 2% in the background art whereas the 100 mesh-over is not larger than 0.5% in the invention. When the 200 mesh-under ratio is 90%, the 100 mesh-over is about 0.7% in the background art whereas the 100 mesh-over is 0% in the invention.

Incidentally, the 100 mesh-over in the case where only the louvers were used and the 100 mesh-over in the case where the louvers and the deflection ring ($H/H_{RF}$=30%) were combined were obtained as results identical with no difference. Because each louver is inclined at 60° on the downstream side with respect to a horizontal direction, coarse particles are also conveyed along the flow. It is assumed that relatively coarse particles bounced out by collision with each rotary fin and floated in the vicinity of the fin are returned to the grinding zone because a downward flow is formed by each louver. Moreover, because the flow velocity distribution in the rotary classifier inlet can be equalized when louvers are provided, it is assumed that coarse particles hardly enter the classification device so that the particle diameter is uniformized. From these results, it is assumed that classification can be sharpened when louvers (stationary fins) are disposed.

For reduction of grinding power consumption of the mill, it is also important to prevent fine particles from being mixed into the mill grinding zone. Fine powder collected by the classification device is returned into the mill again and overground. When fine particles are mixed into the returned coarse powder, the quantity of coal retained in the mill increases and the mill coal layer differential pressure increases to cause increase of mill power consumption. For this reason, it is preferable that the particles collected by the classification device do not contain any fine particle.

FIG. 15 is a graph showing a result of a classification test device, 200 mesh-under ratio of powder discharged from the classification device and a 38 μm-under ratio of powder collected by the classification device. The 38 μm-under ratio of powder collected by the classification device decreases as the particle size in the classification device outlet decreases. When the invention [combination of louvers and a deflection ring ($H/H_{RF}$=0.3)] is used, the 38 μm-under ratio becomes about 50% or less compared with the background art.

Accordingly, when the louver structure of the invention is used, the coal layer (hold up) in the mill decreases because fine powder is discharged from the mill outlet so that the ratio of fine power returned to the mill grinding zone again is reduced.

Classification accuracy will be described next. As for classification accuracy, a partial classifying efficiency can be calculated based on equation (2) using the particle size distribution and the mass balance obtained by the classification test.

$$Ci=1-(Wf\cdot dFf/dx)/(Wc\cdot dFc/dx) \quad (2)$$

in which Ci is a partial classifying efficiency, Wf is a sample collection quantity in the classifier outlet, We is a sample input quantity, Ff is a particle size distribution (pass ratio) of the sample collected in the classifier outlet, Fc is a particle size distribution (pass ratio) of the input sample, x is a particle diameter, dFf/dx is a frequency distribution of the sample collected in the classifier outlet, and dFc/dx is a frequency distribution of the input sample.

Further, a method in which the partial classifying efficiency obtained based on equation (2) is approximated with a Rosin-Rammler diagram (RR diagram) to calculate a slope n (sharpness) thereof is used.

FIG. 16 is a graph for comparing experimental results of classifying accuracy sharpness according to the background art and the invention using the classification test device. Classifying accuracy sharpness is separation efficiency in accordance with each particle size distribution. The larger value expresses the more sharp classification.

As is apparent from this graph, both in the classification device according to the invention and in the classification device according to the background art, the sharpness increases to sharpen classification as the particle size 200 mesh-under ratio in the outlet of the classification device increases, and it is found out that the classifying accuracy sharpness in the invention is high in all particle size ranges compared with the conventional structure. In the condition that the 200 mesh-under ratio is 90%, the sharpness is 1.29 times.

FIG. 17 shows the relation between sharpness and grinding power consumption reduction rate due to simulation based on the result of FIG. 16. It is found out that the grinding power consumption reduction rate increases as the sharpness increases. This is because when classification is sharpened, the quantity of fine powder returned to the mill grinding zone is reduced and the hold-up in the mill decreases. As a result, when the louver type stationary classifier according to the invention is used, the grinding power consumption reduction rate of about 10% can be achieved.

FIG. 18 is a graph showing an experimental result of coal layer differential pressure on a pilot mill for comparing a classification device according to the invention with a classification device according to the background art. As is apparent from this graph, in the classification device according to the invention, the coal layer differential pressure can be reduced by about 65% at a pulverization particle size 200 mesh-under ratio of 85% and reduced by about 50% at a pulverization particle size 200 mesh-under ratio of 90% compared with the classification device according to the background art.

This is because when classification is sharpened, the quantity of fine powder returned to the mill grinding zone is reduced and the hold-up in the mill is reduced. Mill power consumption is composed of grinding power consumption and power consumption of a fan as an air source. Because the composition ratio of grinding power consumption to fan power consumption is 70% to 30%, reduction of power consumption on the whole of the mill can be attained.

FIG. 19 is a side sectional view for explaining a classification device according to a second embodiment. FIG. 20 is a cross-sectional view taken along the line B-B in FIG. 19, schematically showing important part.

In this embodiment, support members 16 of stationary fins 13 are arranged in a circumferential direction, shaped like plates having the same width as each stationary fin 13, and disposed in a direction perpendicular to the center axis of the device. With respect to the angle and direction of each stationary fin 13 with the direction of radius of rotation of a rotary classifier 20, the stationary fins 13 are disposed at the same position and angle and in the same direction as rotary fins 21 of the rotary classifier 20 provided in the inside of the stationary fins 13. Incidentally, the angle is not particularly limited and the angle with the direction of radius of rotation is in a range of from 20° to 50°. The stationary fin support members 16 are disposed at circumferentially regular intervals and the number of the stationary fin support members 16 is 8 to 16, sufficient to reinforce the stationary fins 13.

A deflection ring 33 is further disposed between the stationary fins 13 and the rotary fins 21. Accordingly, after gasses or particles pass through the support members 16, the direction of a gas and particle flow in a section of the classification device is formed in the direction of rotation of the rotary classifier 20 provided in the inside of the stationary fins 13, by the support members 16. As for a method of applying these stationary fin support members 16 and stationary fins 13, when cleavages are provided in the support members 16 so that the stationary fins 13 are inserted into the cleavages respectively, the number of welding places can be reduced.

FIG. 21 is a side sectional view for explaining a classification device according to a third embodiment. FIG. 22 is a cross-sectional view taken along the line D-D in FIG. 21, schematically showing important part. The basic structure is the same as shown in FIGS. 19 and 20.

In this embodiment, support members 17 are extended inward of stationary fins 13 so that the width of each support member 17 is longer than that of each stationary fin 13. The width thereof is formed so as to be about twice as large as the stationary fin width. The stationary fin support members 17 are disposed in a direction perpendicular to the center axis of the device. The angle thereof is disposed in the same direction and position as an angle between each rotary fin 21 of a rotary classifier 20 provided in the inside of the stationary fins 13 and the direction of radius of rotation. The angle thereof is not particularly limited and the stationary fin support members 17 are operated at an angle in a range of from 20° to 50° with respect to the direction of radius of rotation. The stationary fin support members 17 are disposed at circumferentially regular intervals, and the number of the stationary fin support members 17 is 8 to 16. A deflection ring 33 is disposed between the stationary fins 13 and the rotary fins 21.

Accordingly, after gasses and particles pass through the support members 17, the direction of a gas and particle flow in a section of the classification device is formed in the direction of rotation of the rotary classifier 20 provided in the inside of the stationary fins 13, by the support members 17. In this embodiment, because the width of each support member 17 is extended compared with the embodiment described with reference to FIG. 19, reinforcement of a convolute flow in the rotary fin inlet can be attained.

FIG. 23 is a side sectional view for explaining a classification device according to a fourth embodiment. FIG. 24 is a cross-sectional view taken along the line E-E in FIG. 23, schematically showing important part.

In this embodiment, vertical rectifying plates 19 are additionally provided on the outside of the stationary fins 13. However, vertical rectifying plates 19 can be additionally provided on the inside of the stationary fins 13 in place of the outside of the stationary fins 13. Although FIG. 24 shows the case where each stationary fin 13 and each rectifying plate 19 are near to each other, there is no particular limitation and a gap may be provided between the rectifying plate 19 and the stationary fin 13. The angle between the rectifying plates 19 and the direction of radius of rotation of the rotary classifier 20 is disposed in the same direction as the rotary classifier 20 provided inward of the stationary fins 13.

Accordingly, after gasses and particles pass through the rectifying plates 19, the direction of a gas and particle flow in a section of the classification device is formed in the direction of rotation of the rotary classifier 20 provided inward of the stationary fins 13, by the rectifying plates 19. In this embodiment, the support members 14 for the stationary fins 13 have the same configuration as shown in FIG. 2. Because the rectifying plates 19 are located outside of the rotary fins 21, it is desirable that the number of the rectifying plates 19 is large.

The stationary fins (louvers) accelerates equalization of the flow velocity distribution in the vertical direction of the rotary classifier inlet, whereas the second to fourth embodiments attain equalization of the flow velocity distribution in the planar direction in the inside of the rotary classifier. FIG. 25 shows a schematic view of a flow of particle and air in the rotary classifier.

Fine particles in particles conveyed with the air flow are classified without collision with the rotary fins and discharged out of the system. On the other hand, coarse particles are out of the air flow, collide with the rotary fins, and classified to particles to be returned to the grinding zone again. As shown in FIG. 25, burble of the air flow occurs in a side (rear side) opposite to the direction of rotation of the rotary fins. When the burble region increases, there is a possibility that classification will become unstable and at the same time the rotary fins will be worn away because a backflow is generated to retain particles.

FIG. 26 is a graph showing the flow velocity distribution in the center portion between two rotary fins, arranged by flow analysis. In this graph, the invention shows a structure in which the angle of each support member in the rotary fin inlet side is inclined at 45 degrees in the same direction as the rotary fin, and the background art shows a structure in which support members are disposed radially. In the graph, the vertical axis expresses the velocity ratio (velocity/average velocity) in the center portion between two rotary fins, and the horizontal axis expresses the distance between the two rotary fins.

This shows that the aforementioned burble occurs in a backflow on the minus side of the velocity ratio in the center portion between the rotary fins. As is apparent from this graph, in the invention, the burble region is reduced to a half or less compared with the background art.

Moreover, the flow velocity distribution between the rotary fins is equalized. The maximum value of the velocity ratio in the center portion between the rotary fins in the background art is 4.3, whereas the maximum value of the velocity ratio in the center portion between the rotary fins in the invention is as small as 3.0. After gasses and particles pass through the support members or rectifying plates, the direction of a gas and particle flow in a section of the classification device is rectified to the same direction as the rotation angle of the rotary fins by the support members disposed in the vertical direction in the inlet of each rotary fin or by the rectifying plates provided near to the rotary fins, so that the burble region can be reduced and the flow velocity distribution between the rotary fins can be equalized. As a result, improvement in classifying efficiency can be attained.

When the invention is carried out, the quantity of the pulverized substance circulated to the grinding zone is reduced by improving classifying performance, so that the quantity of coal held in the mill is reduced to obtain the effect of reducing mill differential pressure and at the same time reducing mill power consumption. It is a matter of course that there is an effect of improving pulverized particle size under constant power consumption. Accordingly, a classification device capable of producing product fine powder of relatively hard coal little in mixture ratio of coarse particles, and a vertical pulverizing apparatus having the classification device can be achieved.

Accordingly, when the invention is applied to a vertical pulverizing apparatus for coal fired boiler, boiler efficiency can be improved because unburned carbon in ash can be kept low even when poor pulverizable coal or coal easily causing induction of self-excited vibration in the vertical pulverizing apparatus is used. Moreover, because inexpensive low-quality coal can be used, there is great contribution to reduction in power generation cost.

Although the embodiments have been described about a vertical roller mill, the invention can be applied also to a vertical ball mill.

Figure 1:
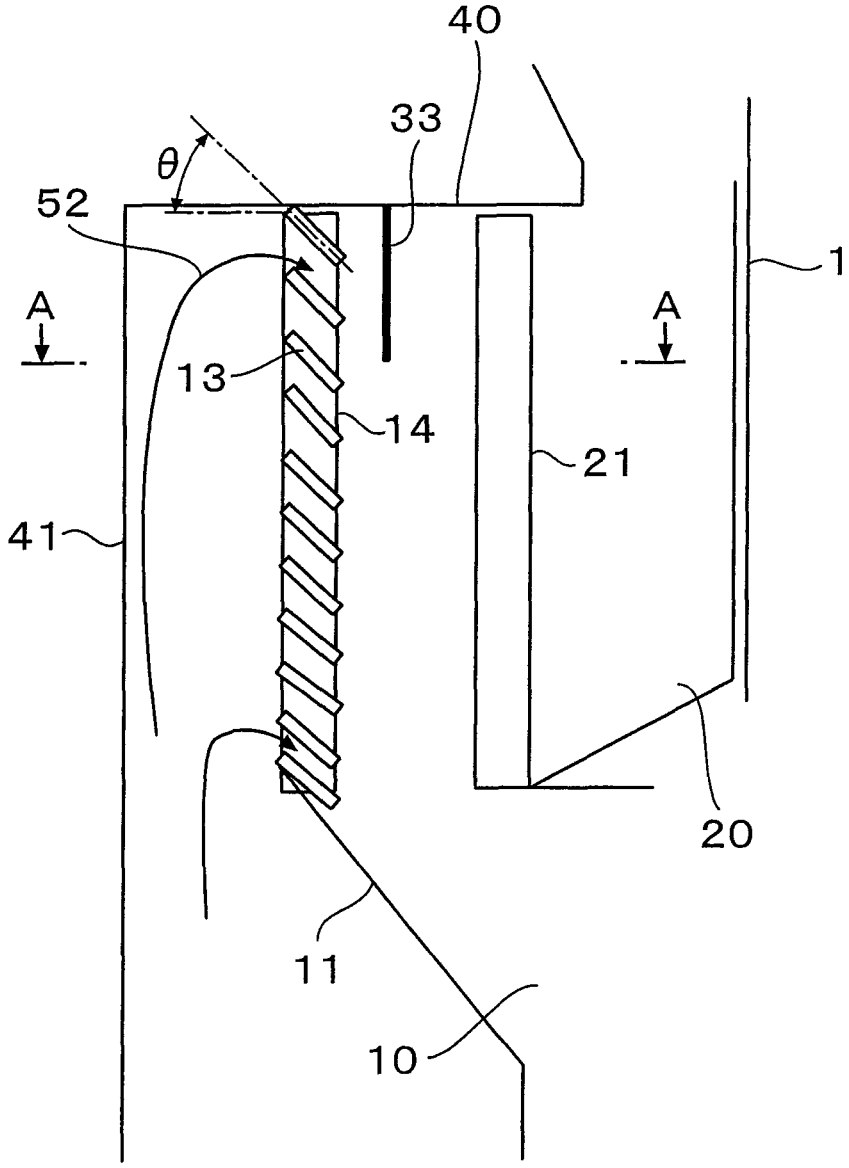
FIG. 1 A schematic vertical sectional view showing important part of a classification device according to a first embodiment of the invention.
Figure 2:
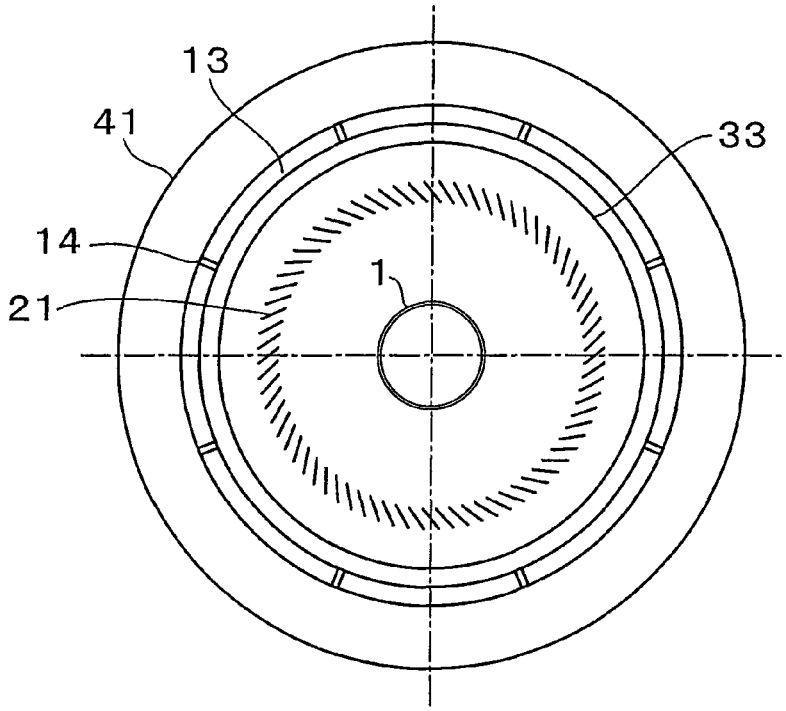
FIG. 2 A schematic horizontal sectional view taken along the line A-A in FIG. 1.
Figure 3:
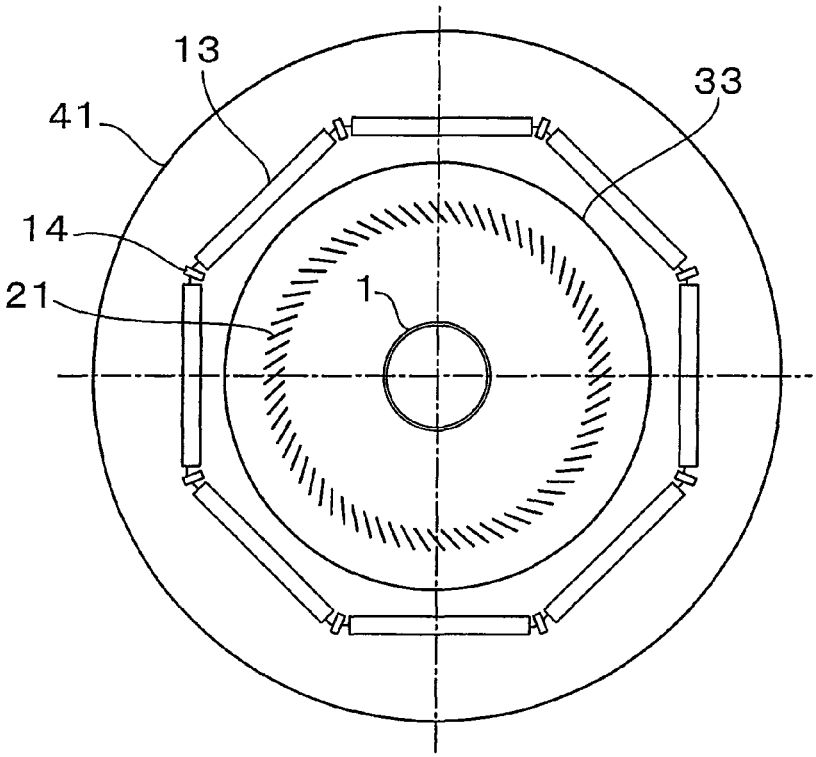
FIG. 3 A schematic horizontal sectional view taken along the line A-A in FIG. 1, showing a modification of stationary fins.
Figure 4:
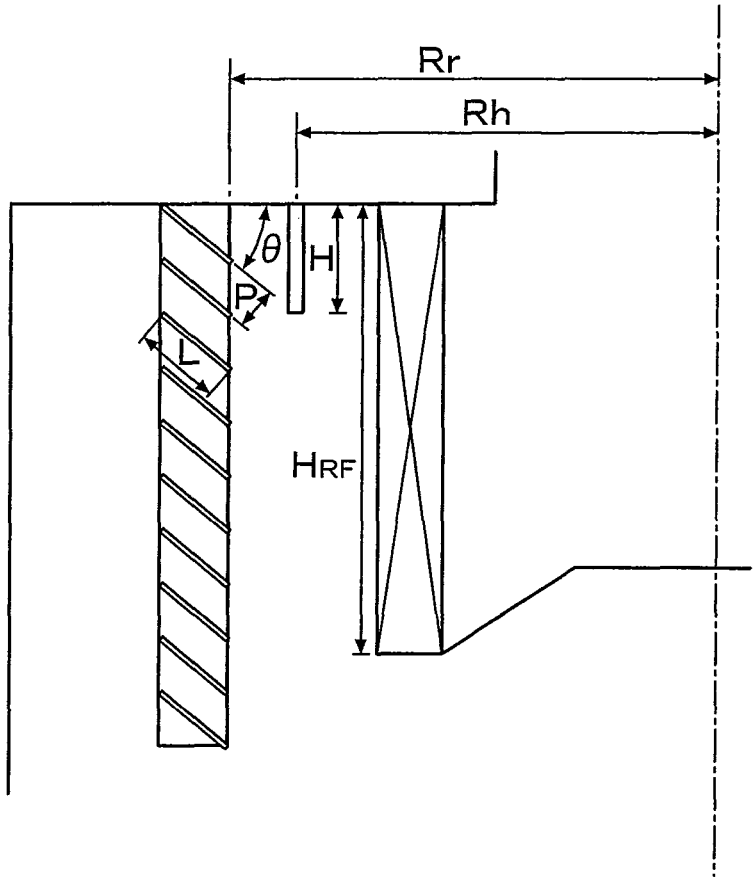
FIG. 4 A reference view in which symbols are attached to respective portions of the classification device.
Figure 5A:
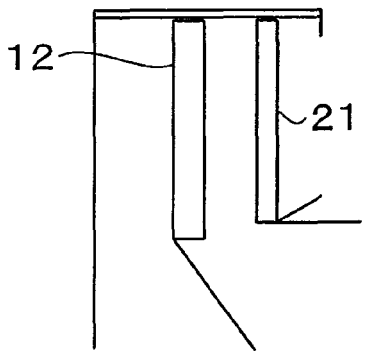
FIG. 5 A view showing configurations of types of classification devices and results of flow analysis of the respective classification devices.
Figure 5B:
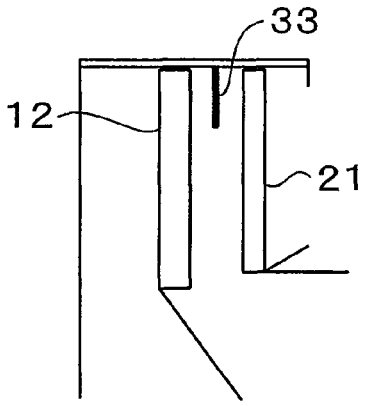
Figure 5C:
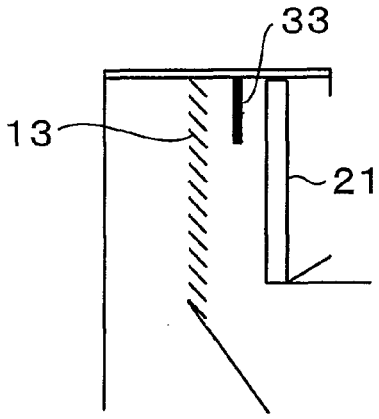
Figure 5D:
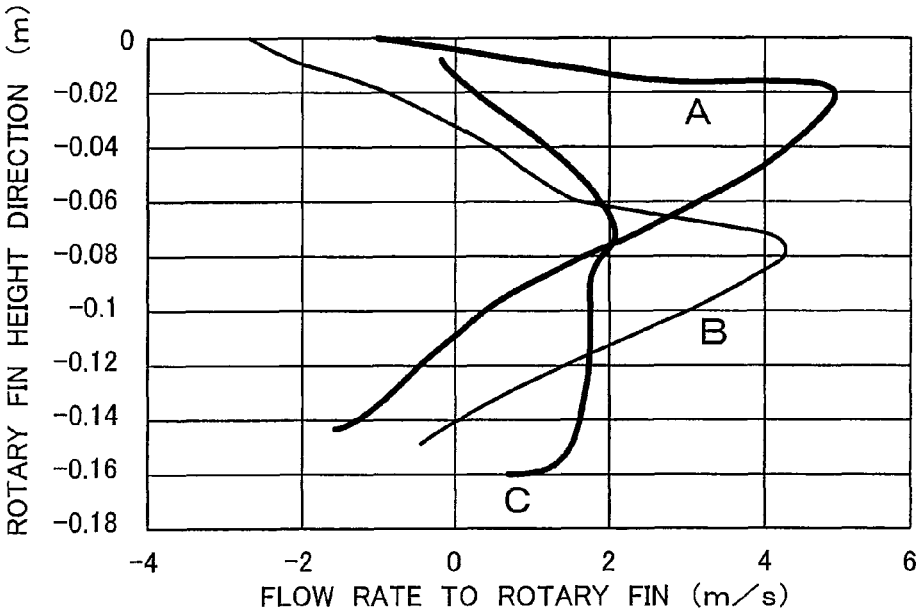
Figure 6:
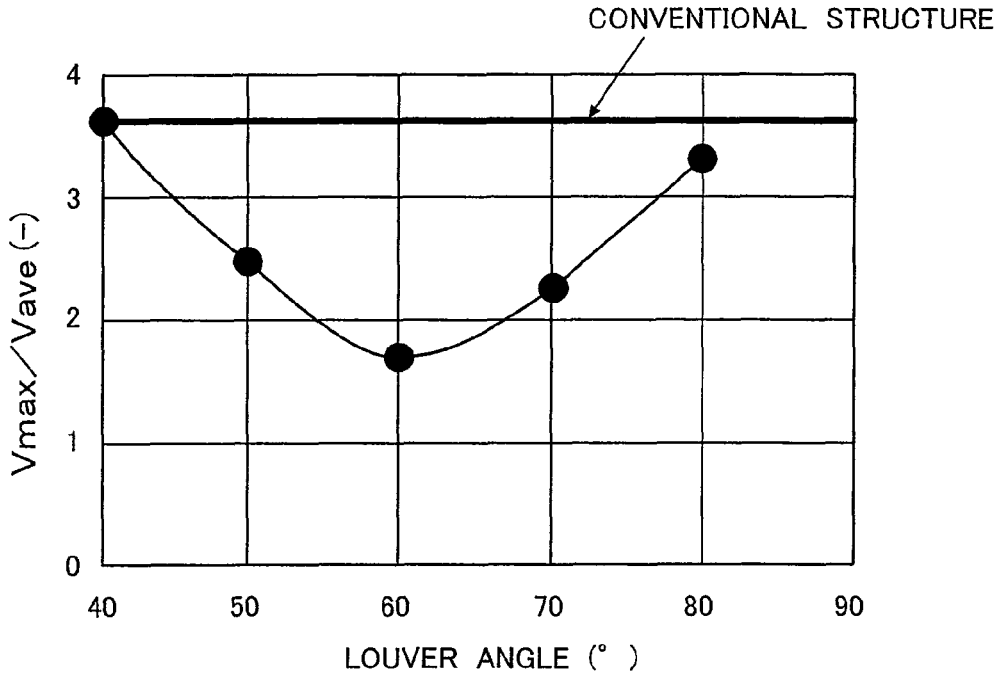
FIG. 6 A graph showing the relation between louver angle θ and flow velocity distribution Vmax/Vave in a rotary fin inlet.
Figure 7:
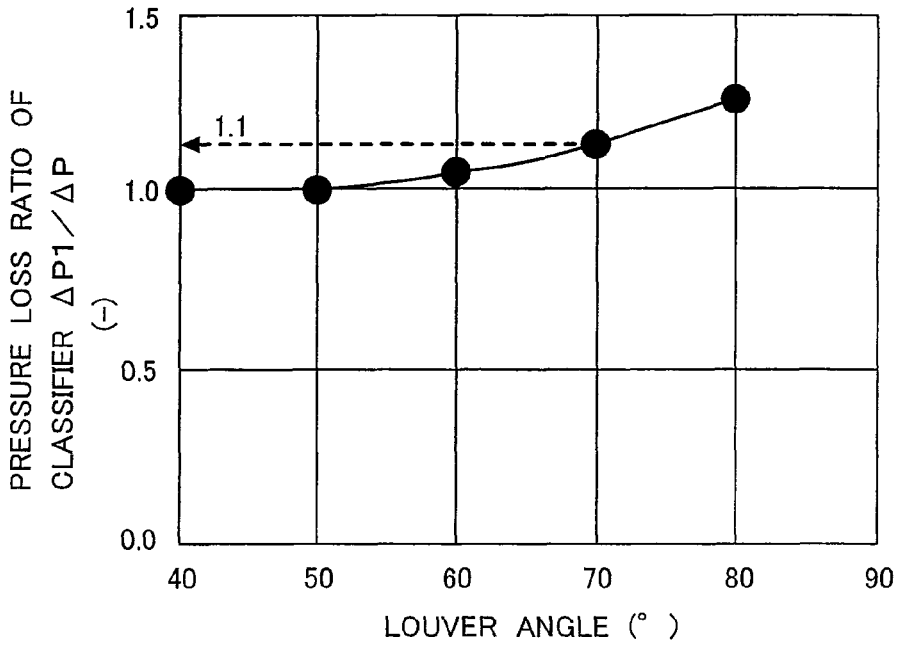
FIG. 7 A graph showing the relation between louver angle θ and pressure loss ratio in a stationary classifier.
Figure 8:
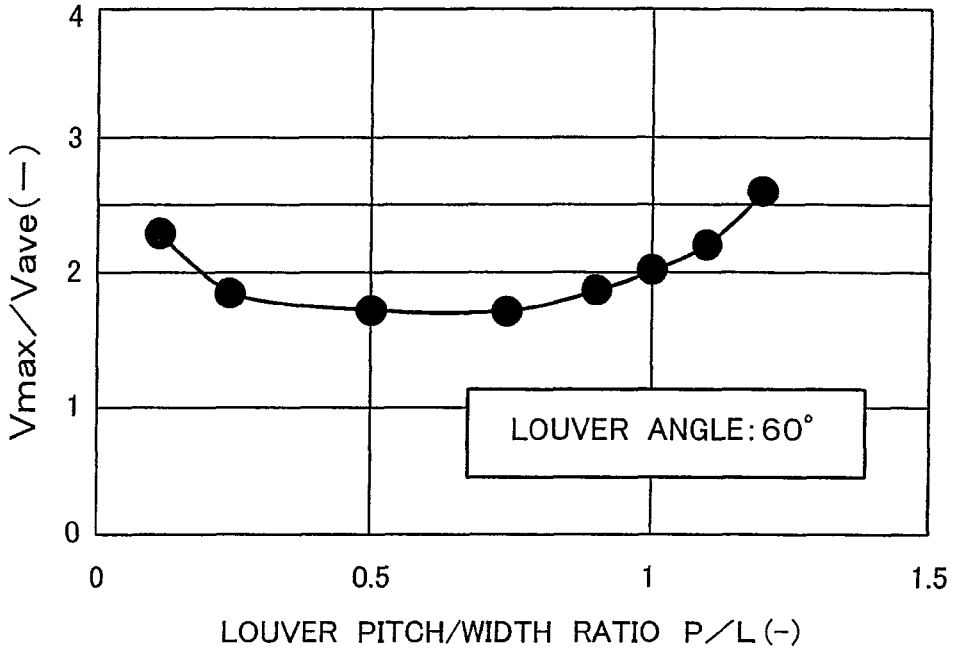
FIG. 8 A graph of the obtained relation between P/L and Vmax/Vave at a louver angle of 60°.
Figure 9:
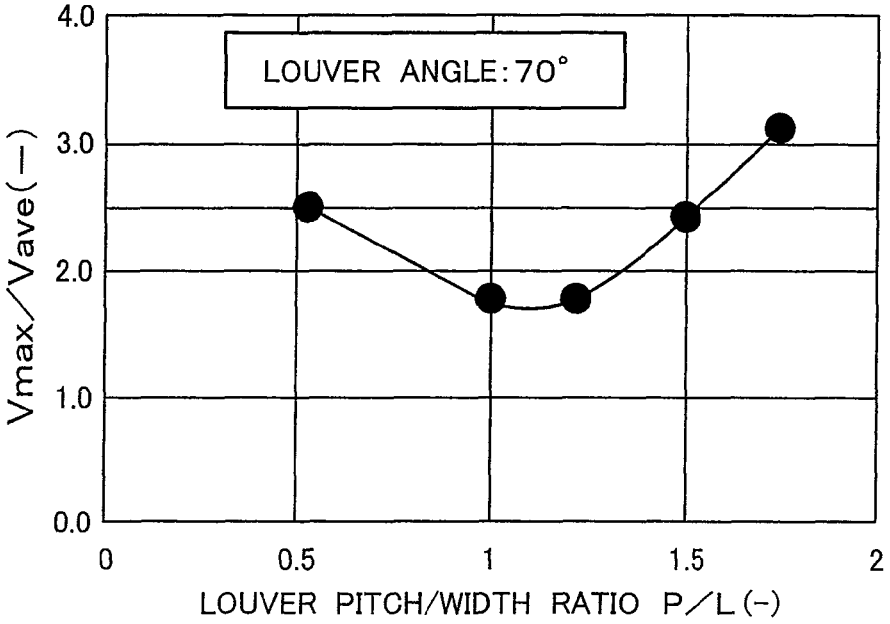
FIG. 9 A graph of the obtained relation between P/L and Vmax/Vave at a louver angle of 70°.
Figure 10:
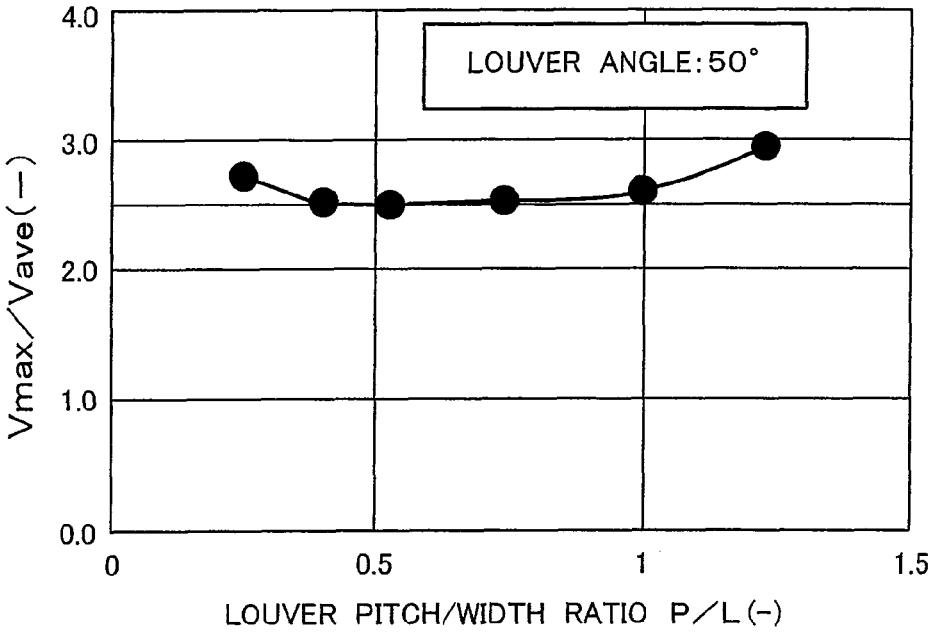
FIG. 10 A graph of the obtained relation between P/L and Vmax/Vave at a louver angle of 50°.
Figure 11:
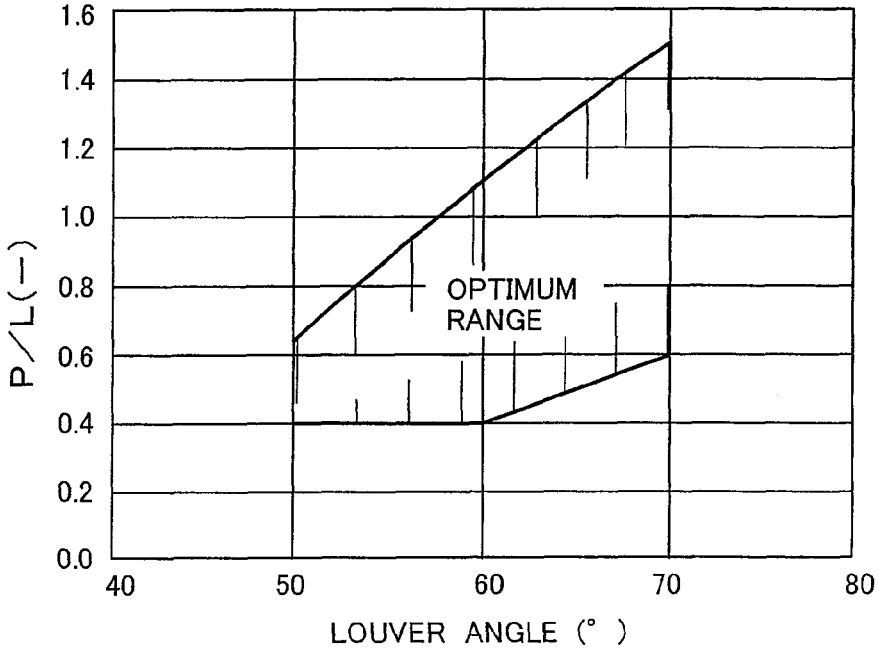
FIG. 11 A graph collectively showing an optimum range of P/L in a louver angle range of 50° to 70°.
Figure 12:
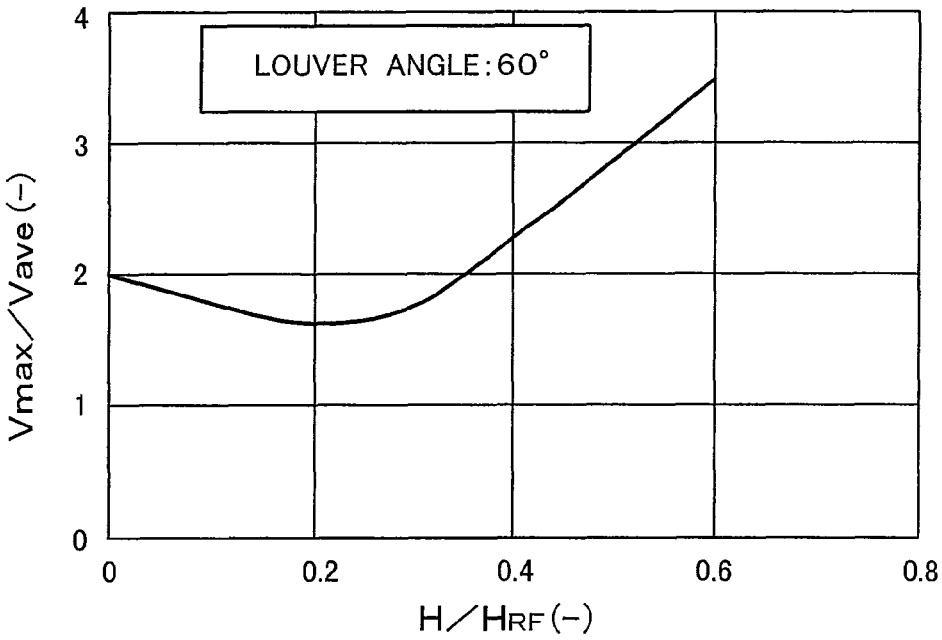
FIG. 12 A graph of the obtained relation between $H/H_{RF}$ and Vmax/Vave.
Figure 13:
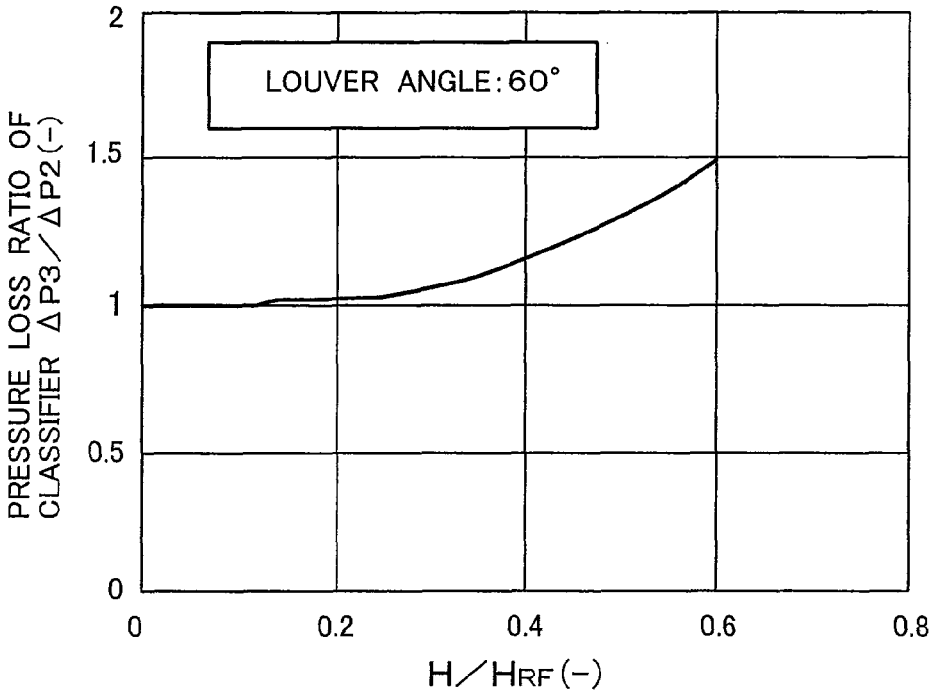
FIG. 13 A graph of the obtained relation between $H/H_{RF}$ and classifier pressure loss.
Figure 14:
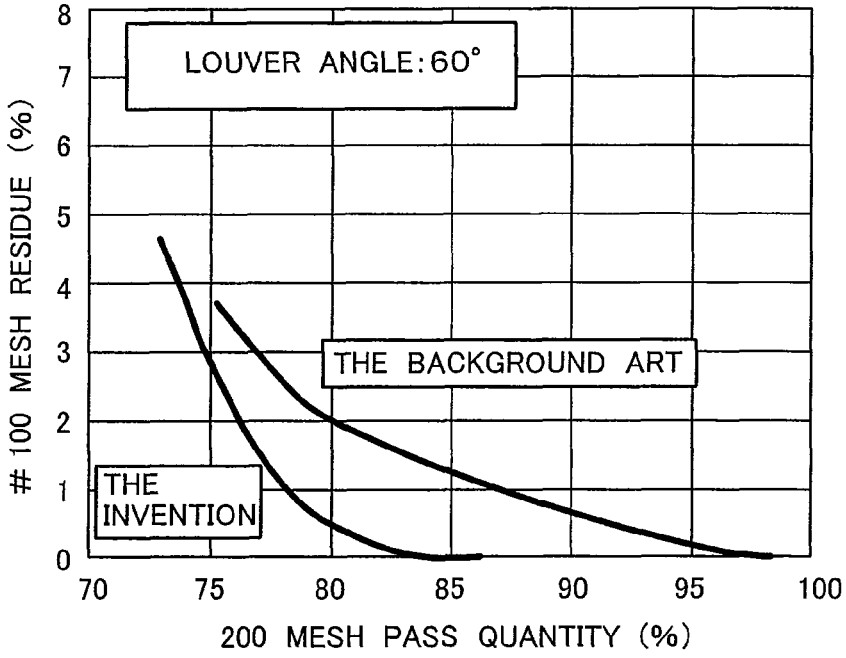
FIG. 14 A classifying characteristic graph showing a mixture ratio of 100 mesh-over when the 200 mesh-under ratio of fine powder collected from a mill outlet is changed.
Figure 15:
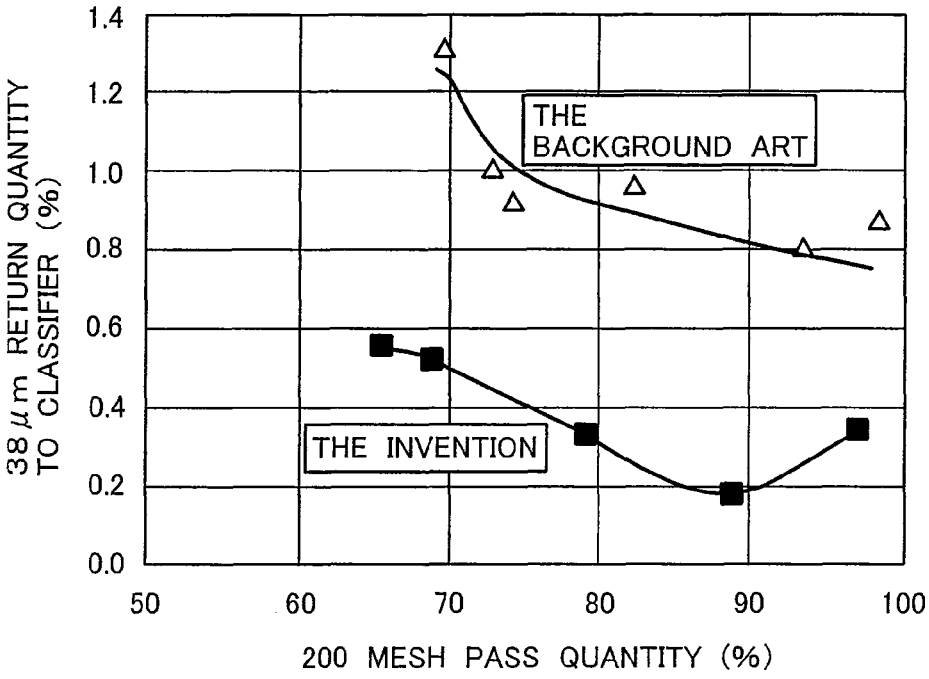
FIG. 15 A graph showing a result of the classification test device, 200 mesh-under ratio of powder discharged from the classification device and a 38 μm-under ratio of powder collected by the classification device.
Figure 16:
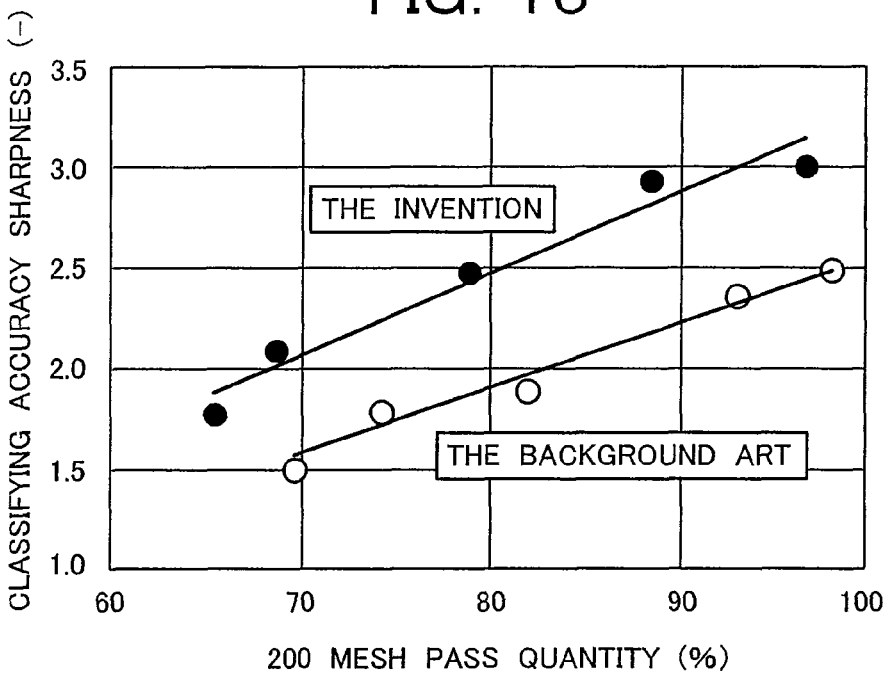
FIG. 16 A graph for comparing experimental results of classifying accuracy sharpness according to the background art and the invention using the classification test device.
Figure 17:
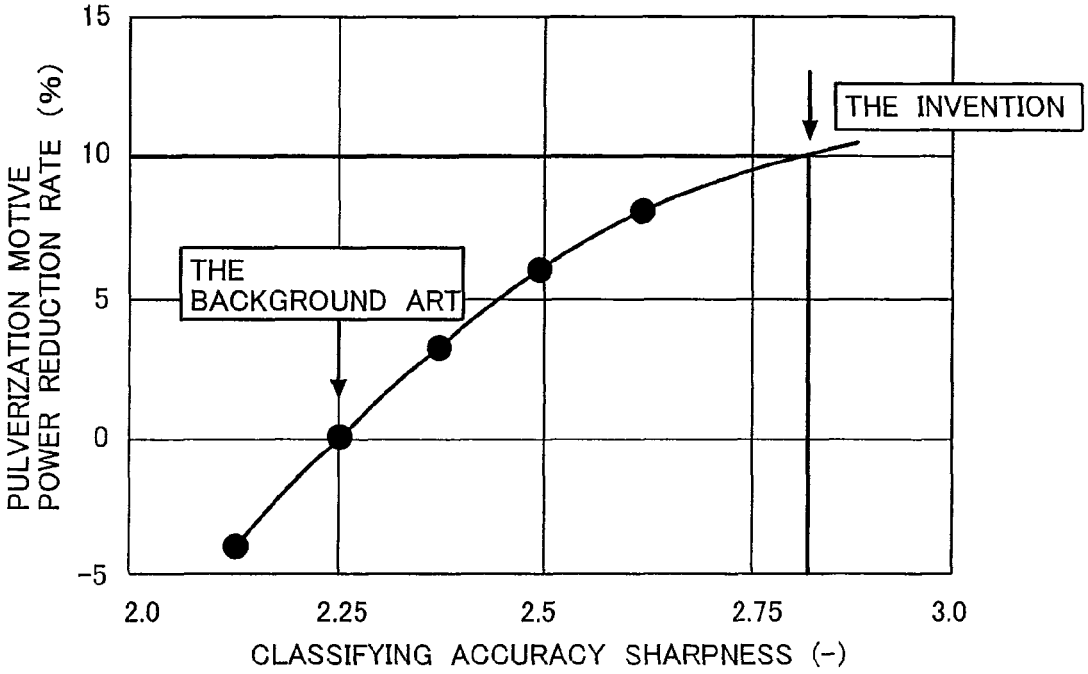
FIG. 17 A graph showing the relation between sharpness and grinding power consumption reduction rate due to simulation.
Figure 18:
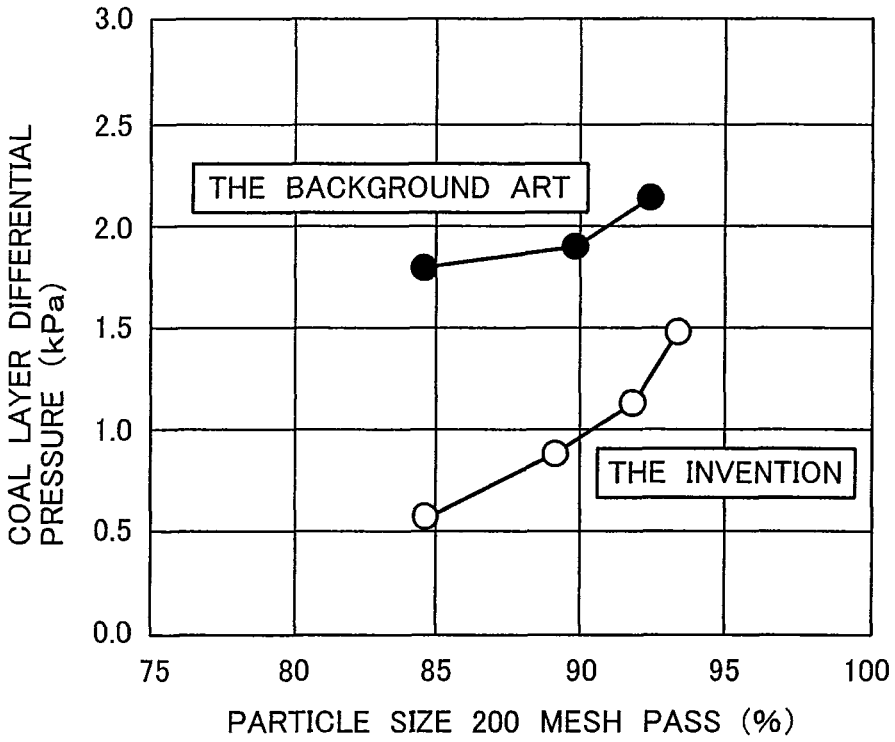
FIG. 18 A graph showing an experimental result of coal layer differential pressure (mill differential pressure) on a pilot mill for comparing a classification device according to the invention with a classification device according to the background art.
Figure 19:
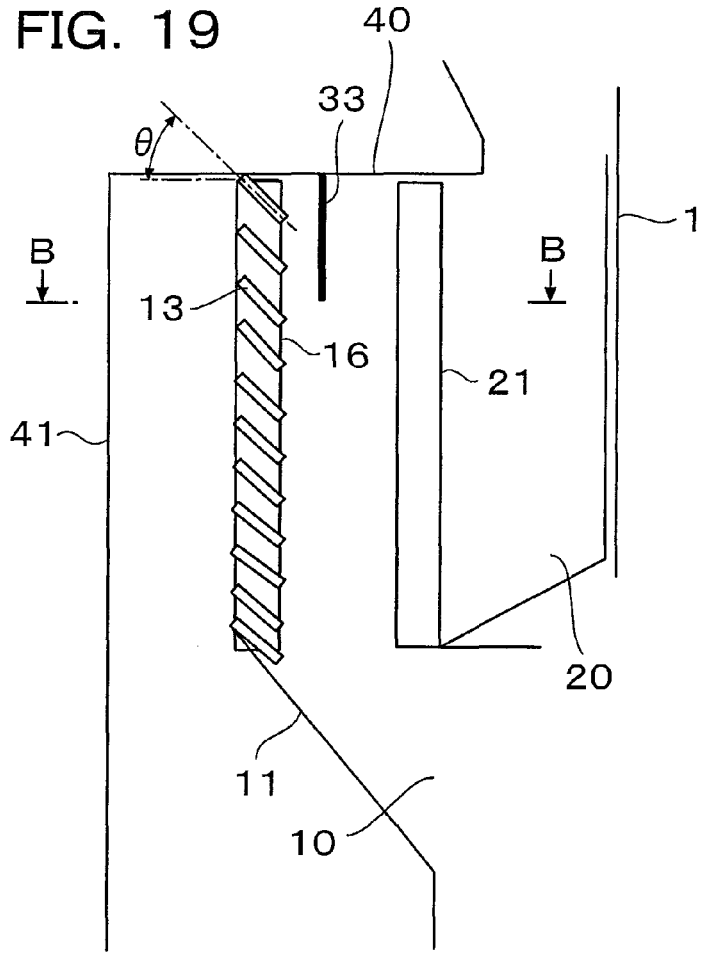
FIG. 19 A schematic vertical sectional view showing important part of a classification device according to a second embodiment of the invention.
Figure 20:
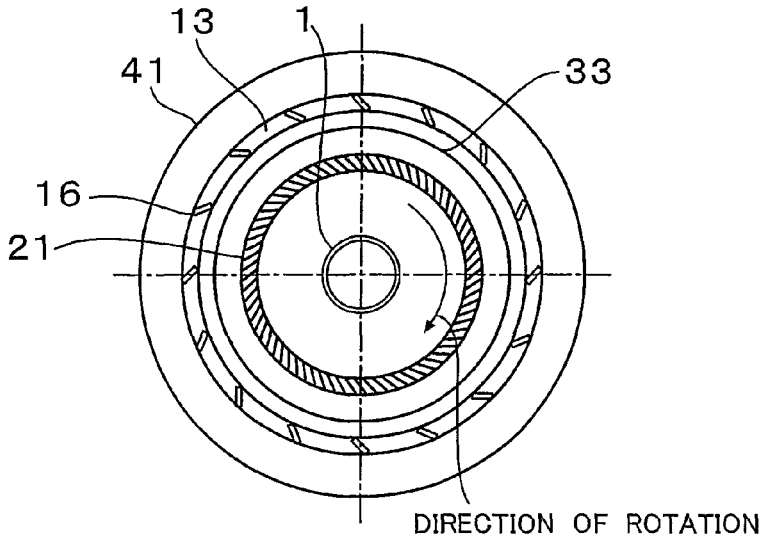
FIG. 20 A schematic horizontal sectional view taken along the line B-B in FIG. 19.
Figure 21:
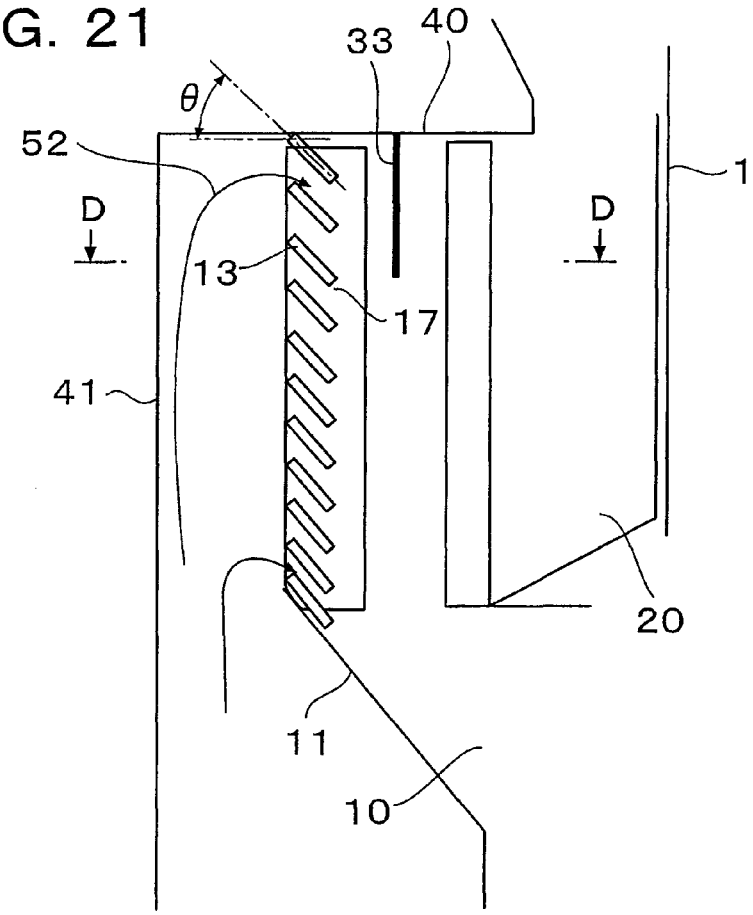
FIG. 21 A schematic vertical sectional view showing important part of a classification device according to a third embodiment of the invention.
Figure 22:
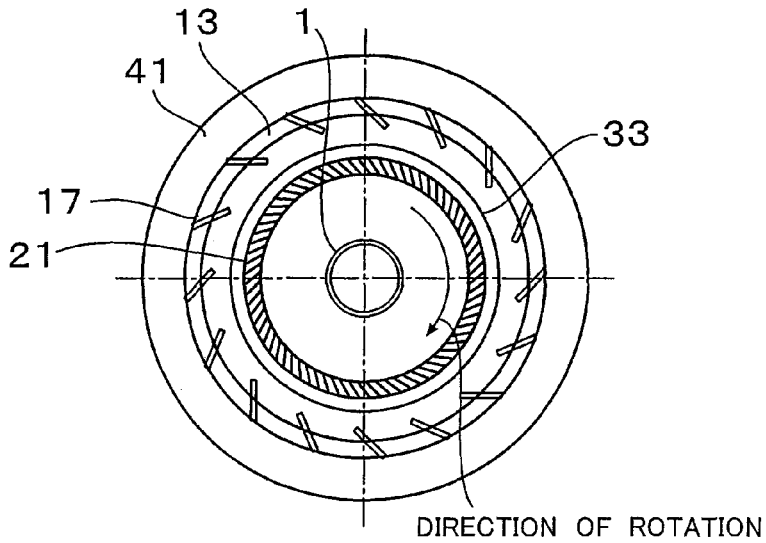
FIG. 22 A schematic horizontal sectional view taken along the line D-D in FIG. 21.
Figure 23:
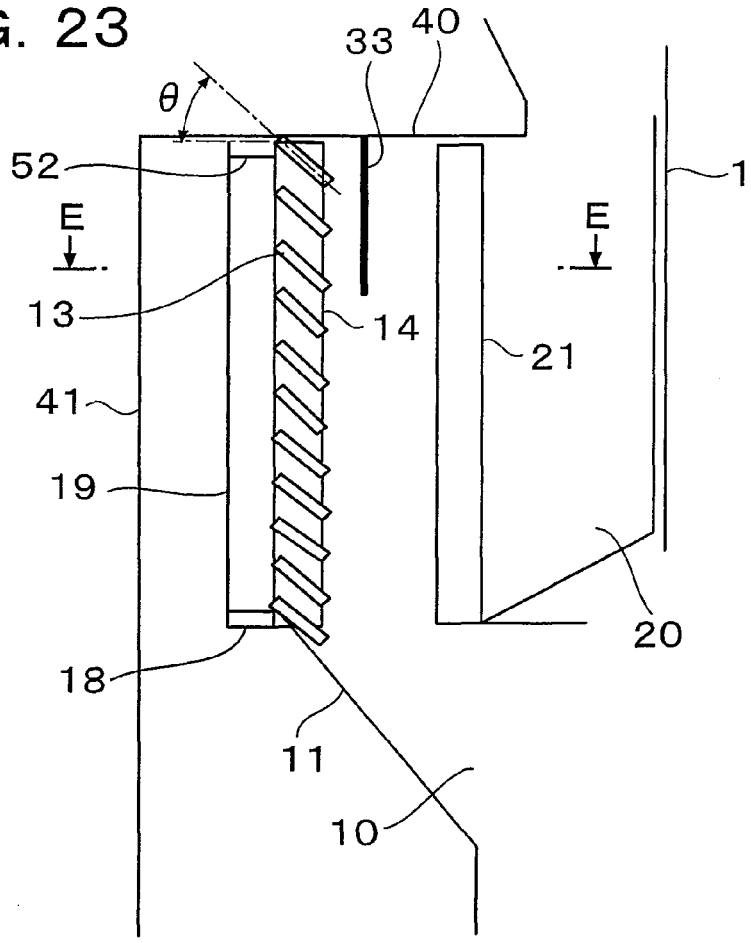
FIG. 23 A schematic vertical sectional view showing important part of a classification device according to a fourth embodiment of the invention.
Figure 24:
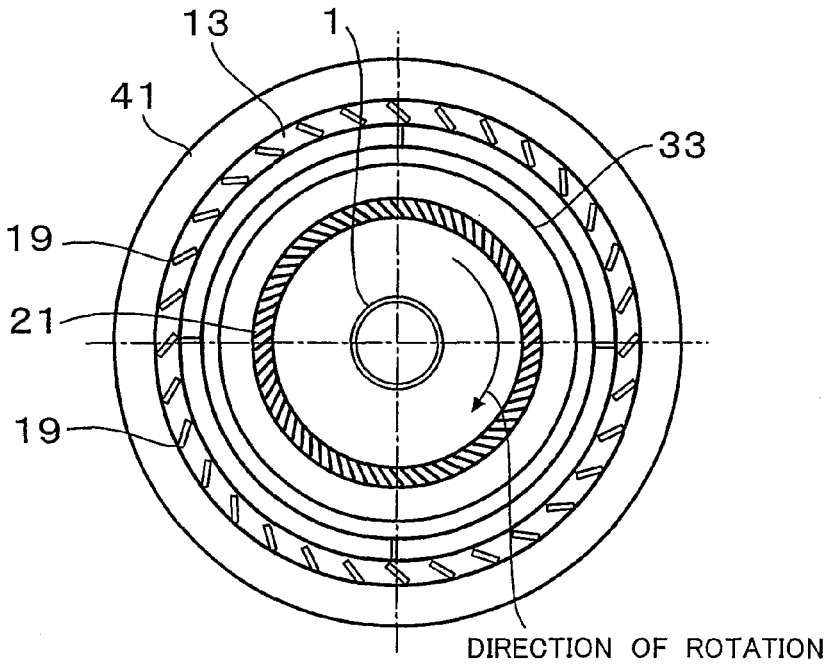
FIG. 24 A schematic horizontal sectional view taken along the line E-E in FIG. 23.
Figure 25:
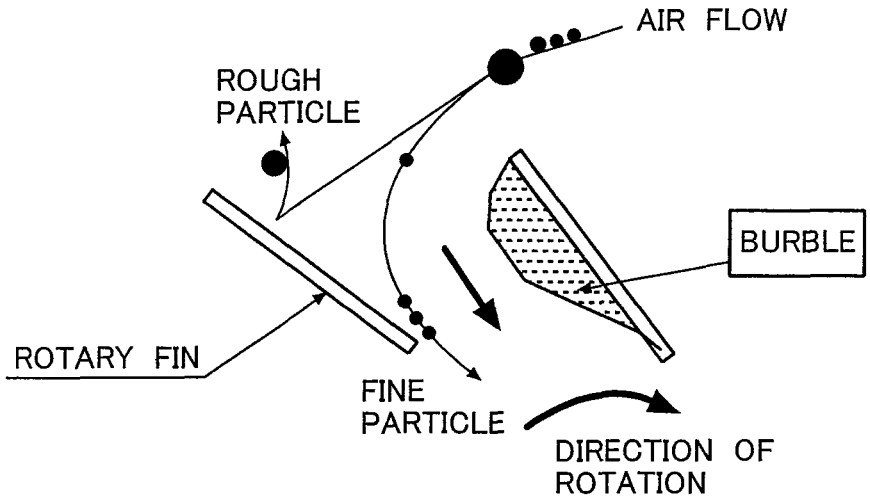
FIG. 25 A schematic view showing a flow of particles and air in the rotary classifier.
Figure 26:
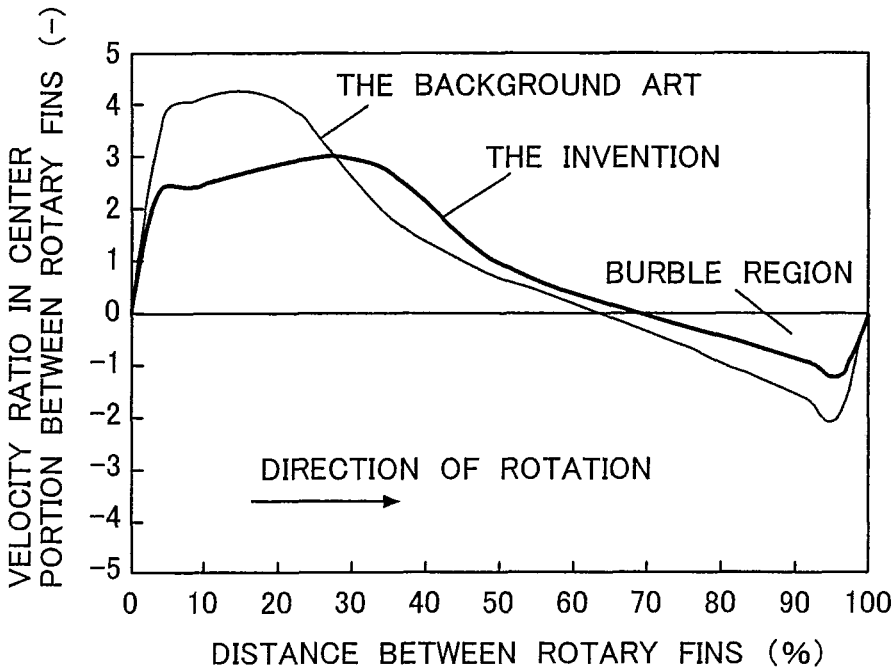
FIG. 26 A graph showing the flow velocity distribution in the center portion between two rotary fins, arranged by flow analysis.
Figure 27:
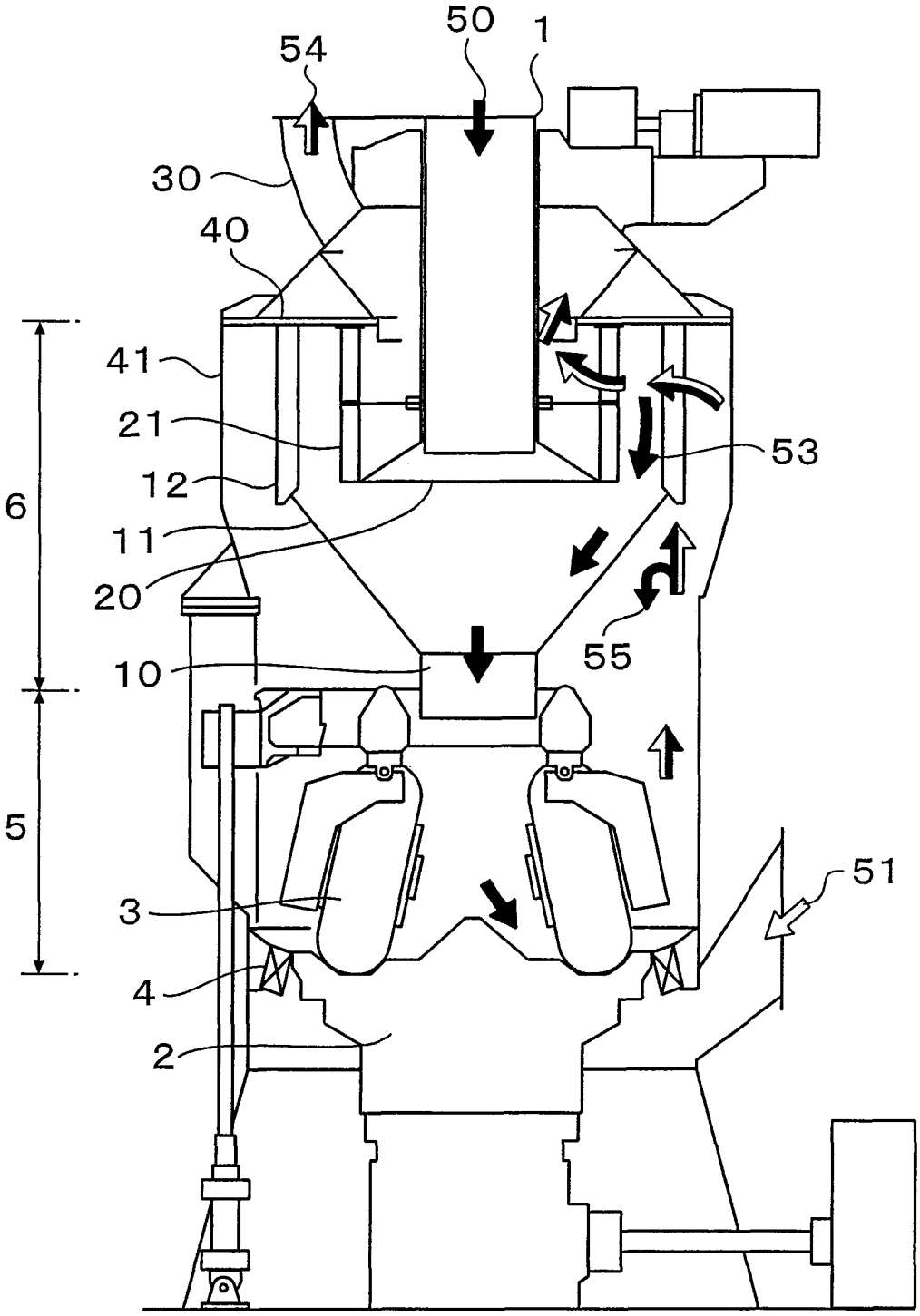
FIG. 27 A view showing the schematic configuration of a standing roller mill.
Figure 28:
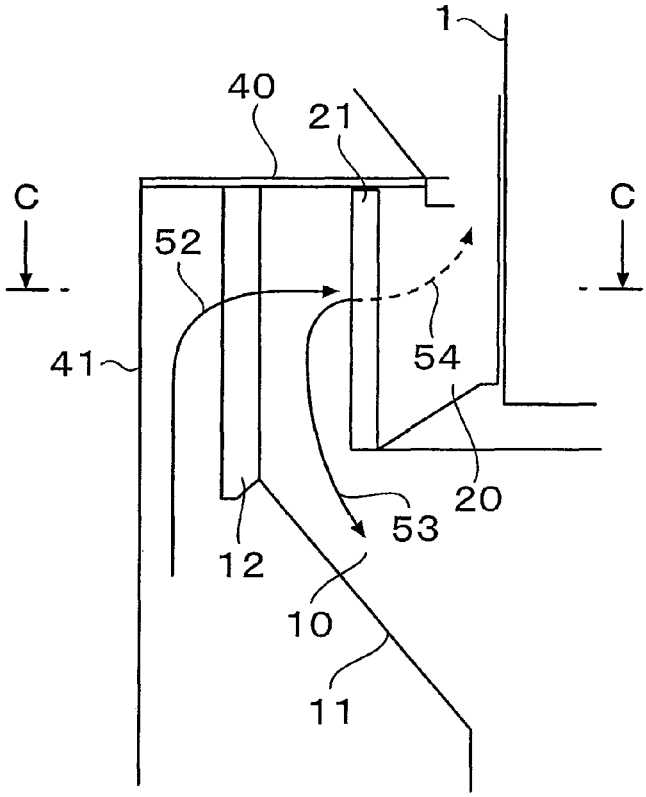
FIG. 28 A schematic vertical sectional view showing important part of a classification device according to the background art.
Figure 29:
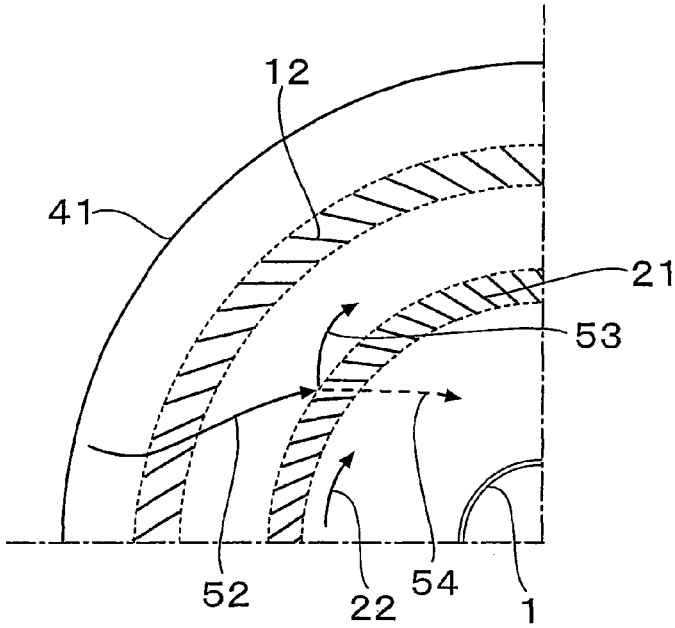
FIG. 29 A schematic horizontal sectional view taken along the line C-C in FIG. 28.
Figure 30:
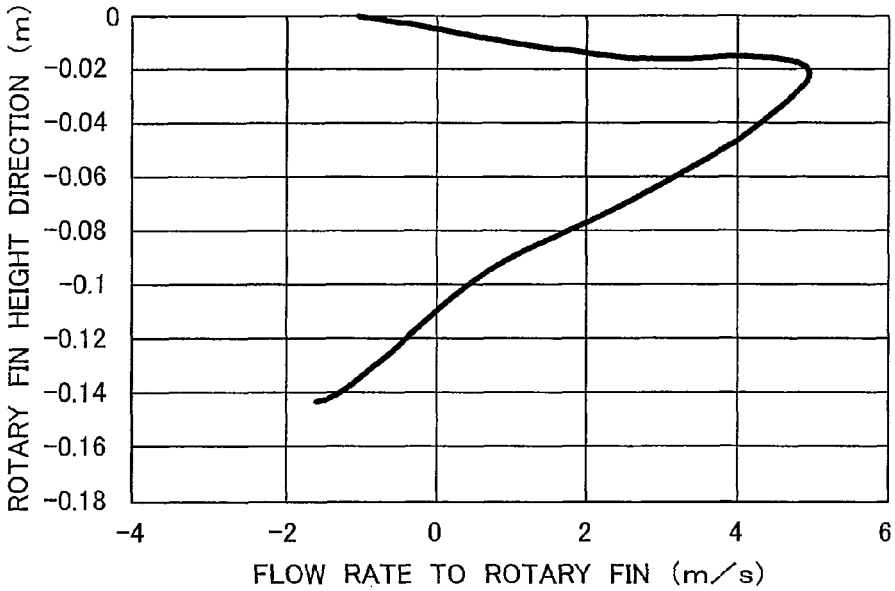
FIG. 30 An explanatory graph showing an analytic result of the flow velocity distribution in a classification device according to the background art.
Figure 31:
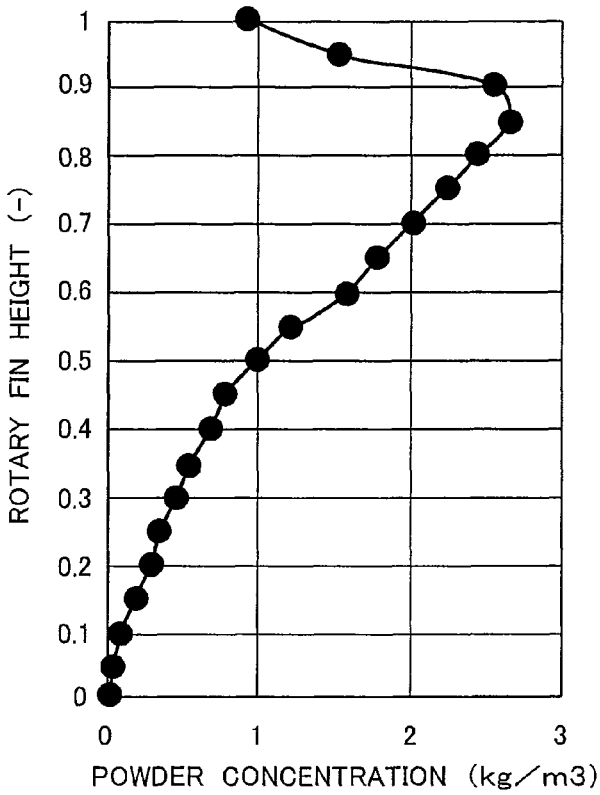
FIG. 31 An explanatory graph showing an analytic result of the powder concentration in a classification device according to the background art.
Figure 32:
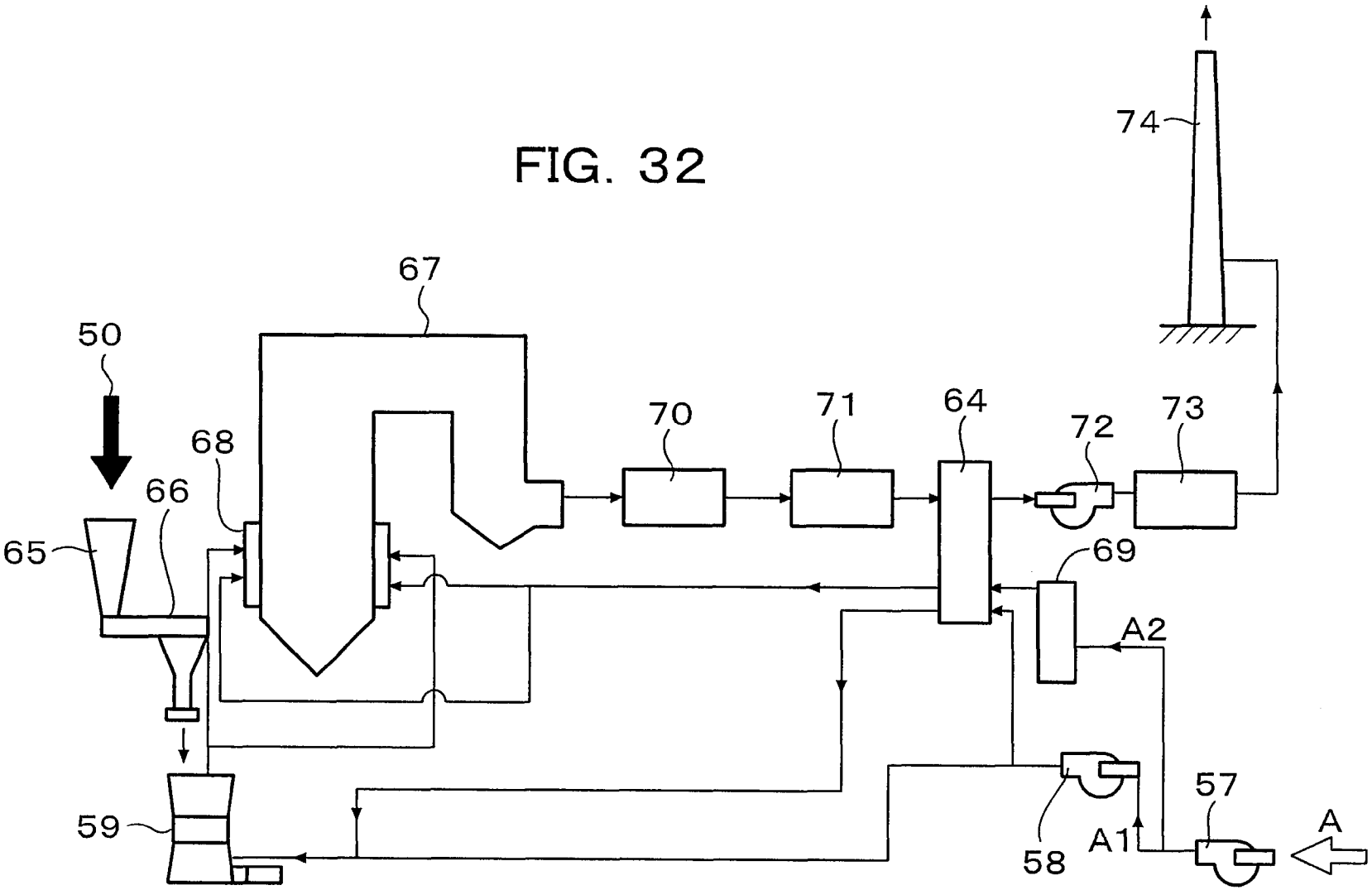
FIG. 32 A schematic configuration diagram of the whole of a coal fired boiler apparatus having a vertical roller mill.

The invention claimed is:

1. A classification device comprising:

a stationary classifier having a cylinder shape and hung down from a device top portion;

a rotary classifier disposed inside the stationary classifier;

a cylindrical deflection ring hung down from the device top portion between the stationary classifier and the rotary classifier to form a downward flow;

a rectifying cone having a downward convexly curved cone shape and disposed under the stationary classifier; and a classification zone outer circumference housing which covers a classification zone composed at least of the stationary classifier, the rotary classifier, the deflection ring, the rectifying cone;

the rotary classifier including a large number of rotary fins arranged in a circumferential direction, each rotary fin having a length direction of a plate facing a vertical direction and disposed at an arbitrary angle with respect to a direction of a center axis of the device, characterized in that:

the stationary classifier includes stationary fin groups attached multistageously and each having a plurality of stationary fins disposed annularly with respect to the center axis of the device, each of the stationary fins being inclined down toward the direction of the center axis of the device;

an inclination angle of each stationary fin is limited to a range of 50° to 70° with respect to a horizontal direction;

a setting pitch P between the stationary fins and a width L of each stationary fin in a direction of particles flowing are combined so that a value of P/L is in a range defined by an upper limit line $P/L=0.042\times(\theta-50)+0.65$ in a range $50°<\theta<70°$, a lower limit line $P/L=0.4$ in a range $50°<\theta<60°$ and a lower limit line $P/L=0.019\times(\theta-60)+0.4$ in a range $60°<\theta<70°$ where θ is an inclination angle of each stationary fin, P is the setting pitch between the stationary fins in a multistageous direction, and L is the width of each stationary fin in the direction of particles flowing;

when an ascending solid-gas two-phase flow composed of a mixture of solid particles and a gas enters between the classification zone outer circumference housing and the stationary fin groups and passes between the stationary fins inclined down, the solid-gas two-phase flow collides with surfaces of the stationary fins and changes into a downward flow so that coarse particles with large mass on this occasion fall down toward the rectifying cone side located in a lower zone while solid particles not falling down are carried with an air flow and flow toward the deflection ring and rotary fin side, and a ratio of Vmax and Vave (Vmax/Vave) is set to be no larger than 2.5, where the Vmax is a maximum flow velocity of a rotary fin inlet flow velocity and the Vave is an average flow velocity thereof.

2. A classification device according to claim 1, wherein: both end portions of each stationary fin are supported by support members and the stationary fins are annularly connected to one another through the support members.

3. A classification device according to claim 2, wherein: a value of $H/H_{RR}$ is limited to 1/3 or less when H is a length of the deflection ring from the device top portion, and $H_{RF}$ is a length of each rotary fin.

4. A classification device according to claim 1, wherein: support members supporting the stationary fins are constituted by a plurality of plate members so that a setting angle of each support member is set in such a manner that a direction of a gas and particle flow in a section of the classification device after passage through the support members is adjusted to a direction of rotation of the rotary classifier provided inward of the stationary fins.

5. A classification device according to claim 4, wherein: a width of each of the support members is extended and stretched inward so as to be larger than a width of each stationary fin.

6. A classification device according to claim 1, wherein: rectifying plates formed of a plurality of flat plates are provided in a vertical direction so as to be near to an outer circumference or inner circumference of the stationary fins so that a setting angle of the rectifying plates is set in such a manner that a direction of a gas and particle flow in a section of the classification device after passage through the rectifying plates is adjusted to a direction of rotation of the rotary classifier provided inward of the stationary fins.

7. A vertical pulverizing apparatus comprising a grinding zone having a grinding table and a grinding parts and a classification zone disposed on top of the grinding zone, so that a pulverized substance pulverized by the grinding zone is conveyed with an upward air flow from a throat provided on an outer circumference of the grinding table, and the conveyed pulverized substance is classified by the classification zone in such a manner that fine particles classified thus are taken out of the device while coarse particles classified thus are pulverized again by the grinding zone, characterized in that:

the classification zone is formed of a classification device according to claim 1.

8. A coal fired boiler apparatus comprising a vertical pulverizing apparatus for pulverizing coal, and a boiler for firing pulverized coal obtained by pulverization in the vertical pulverizing apparatus, characterized in that: the vertical pulverizing apparatus is a vertical pulverizing apparatus according to claim 7.

* * * * *